US012161192B2

(12) United States Patent
Ho

(10) Patent No.: US 12,161,192 B2
(45) Date of Patent: Dec. 10, 2024

(54) SYSTEMS AND METHODS FOR MANUFACTURING FOOTWEAR WITH FELTING

(71) Applicant: NIKE, Inc., Beaverton, OR (US)

(72) Inventor: Lai Wa C. Ho, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 1403 days.

(21) Appl. No.: 16/574,468

(22) Filed: Sep. 18, 2019

(65) Prior Publication Data

US 2020/0008527 A1 Jan. 9, 2020

Related U.S. Application Data

(62) Division of application No. 15/589,641, filed on May 8, 2017, now Pat. No. 10,448,706.
(Continued)

(51) Int. Cl.
*D04H 18/02* (2012.01)
*A43B 1/04* (2022.01)
(Continued)

(52) U.S. Cl.
CPC ..... *A43B 23/025* (2013.01); *A43B 1/04* (2013.01); *A43B 23/0235* (2013.01);
(Continued)

(58) Field of Classification Search
CPC ..... D04H 1/46; D04H 18/02; D04H 1/488; D04H 17/00; D04H 5/02; D04H 13/005;
(Continued)

(56) References Cited

U.S. PATENT DOCUMENTS 1,401,466 A 12/1921 De
1,725,749 A 8/1929 Blair
(Continued)

FOREIGN PATENT DOCUMENTS

CN 1342046 3/2002
CN 102713042 10/2012
(Continued)

OTHER PUBLICATIONS

"U.S. Appl. No. 15/409,329, Response filed Jun. 17, 2020 to Non Final Office Action mailed Mar. 17, 2020", 15 pgs.
(Continued)

*Primary Examiner* — Amy Vanatta
(74) *Attorney, Agent, or Firm* — Schwegman, Lundberg & Woessner, P.A.

(57) ABSTRACT

A needle assembly for a stitching machine comprises a stitching jig comprising a needle holder, a needle clamp hoop and a fixing jig. The needle holder has needle sockets to hold a plurality of needles. The needle clamp hoop is connected to the needle holder to retain needles in the sockets. The fixing jig is connected to the needle clamp hoop to couple with a reciprocating bar of the stitching machine. A method for manufacturing an article of footwear upper comprises laying out a first sheet of material; positioning a second sheet of material to overlap with the first sheet of material at an overlap; positioning a felt material adjacent the overlap so that the second sheet of material is between the first sheet of material and the felt material; and felting the felt material to draw fibers of the felt material through the first and second sheets of material.

19 Claims, 15 Drawing Sheets

Related U.S. Application Data

(60) Provisional application No. 62/409,735, filed on Oct. 18, 2016.

(51) Int. Cl.

| | |
|---|---|
| ***A43B 23/02*** | (2006.01) |
| ***A43D 8/34*** | (2006.01) |
| ***A43D 11/01*** | (2006.01) |
| ***D04H 17/00*** | (2006.01) |
| ***D05B 1/10*** | (2006.01) |
| ***D05B 55/00*** | (2006.01) |
| ***D05B 55/10*** | (2006.01) |
| ***D05B 85/00*** | (2006.01) |
| *A43D 8/16* | (2006.01) |

(52) U.S. Cl.
CPC ..... *A43B 23/026* (2013.01); *A43B 23/0295* (2013.01); *A43D 8/34* (2013.01); *A43D 11/01* (2013.01); *D04H 17/00* (2013.01); *D04H 18/02* (2013.01); *D05B 1/10* (2013.01); *D05B 55/00* (2013.01); *D05B 55/10* (2013.01); *D05B 85/00* (2013.01); *A43D 8/16* (2013.01); *A43D 2200/10* (2013.01)

(58) Field of Classification Search
CPC .... D04H 18/00; D04H 1/498; A43B 23/0205; A43B 23/0245; A43B 23/025; A43B 1/04; A43B 1/02; A43B 23/0235; A43B 23/0255; A43B 23/026; A43B 23/0295; A43B 23/028; A43D 8/00; A43D 8/32; A43D 8/34; A43D 8/14; A43D 11/00; A43D 11/01; A43D 8/16; A43D 2200/10; A43D 999/00
USPC ..... 28/107–115
See application file for complete search history.

(56) References Cited

U.S. PATENT DOCUMENTS 2,158,533 A 5/1939 Cavey
2,235,694 A 3/1941 Wolfhard et al.
2,293,370 A 8/1942 Charles
2,331,321 A * 10/1943 Heaton ..... D06N 7/0068 264/DIG. 75
2,563,916 A 8/1951 Jacob
2,881,724 A 4/1959 Cremer et al.
2,896,303 A 7/1959 Morrill
3,090,099 A * 5/1963 Smith, II ..... D04H 18/00 28/108
3,112,552 A * 12/1963 Smith, II ..... D04H 18/02 428/114
3,284,872 A * 11/1966 Closson, Jr. ..... D04H 1/4258 28/112
3,337,387 A * 8/1967 Owen ..... D04H 1/45 428/102
3,364,098 A 1/1968 Patsis
3,375,561 A * 4/1968 Ford ..... D04H 5/02 987/225
3,441,464 A 4/1969 Blue
3,484,881 A * 12/1969 Krieger ..... A43B 1/0009 36/45
3,497,414 A 2/1970 Blue
3,535,187 A 10/1970 Wood
3,562,931 A 2/1971 Karygiannis
3,605,223 A 9/1971 Barth
3,606,654 A 9/1971 Dilo
3,703,752 A 11/1972 Schulte
3,705,064 A 12/1972 Lochner
3,772,746 A 11/1973 Ivanowicz
3,774,273 A 11/1973 Okamoto et al.
3,794,553 A 2/1974 Lochner
3,865,678 A 2/1975 Okamoto et al.
3,906,599 A * 9/1975 Smith, II ..... D04H 18/02 28/108
3,956,560 A * 5/1976 Smith, II ..... D04H 18/02 428/218
4,007,071 A 2/1977 Addie et al.
4,146,663 A 3/1979 Ikeda et al.
4,211,593 A 7/1980 Lochner
4,250,172 A * 2/1981 Mutzenberg ..... D04H 1/498 442/241
4,353,158 A 10/1982 Henshaw
4,426,414 A * 1/1984 Wilkerson ..... B32B 5/022 28/112
4,568,010 A 2/1986 Dilo
4,667,611 A 5/1987 Yamamoto et al.
4,683,624 A 8/1987 Dufour
4,755,260 A * 7/1988 Sakuma ..... D21F 7/10 162/200
4,783,909 A 11/1988 Van Doren et al.
4,794,874 A 1/1989 Slattery
4,798,760 A 1/1989 Diaz-kotti
4,891,870 A 1/1990 Muller
4,917,032 A 4/1990 Matsumoto
4,935,295 A 6/1990 Serafini
4,955,116 A * 9/1990 Hayamizu ..... D04H 1/46 28/110
5,003,674 A 4/1991 Cohen et al.
5,084,332 A * 1/1992 Burgess ..... D04H 1/46 442/388
5,150,536 A 9/1992 Strong
5,202,170 A * 4/1993 Hsu ..... D21F 7/083 428/113
5,350,255 A 9/1994 Carriker
5,507,900 A 4/1996 Mohammed et al.
5,537,939 A 7/1996 Horton
5,694,872 A 12/1997 Zeller
5,718,180 A 2/1998 Stutznaecker
5,802,739 A 9/1998 Potter et al.
5,858,890 A * 1/1999 Sheehan ..... F16D 69/023 442/388
5,909,883 A 6/1999 Jourde et al.
6,048,810 A 4/2000 Baychar
6,170,414 B1 1/2001 Kaetterhenry et al.
6,237,174 B1 5/2001 Hutchinson
6,402,879 B1 6/2002 Tawney et al.
6,446,360 B1 9/2002 Sheets et al.
6,743,519 B2 6/2004 Widdemer
7,246,418 B2 7/2007 Falk et al.
7,347,011 B2 3/2008 Dua et al.
7,966,956 B2 6/2011 Susuki et al.
8,429,835 B2 4/2013 Dojan et al.
8,544,191 B2 10/2013 Marvin et al.
8,731,696 B2 5/2014 Jones et al.
8,739,716 B2 6/2014 Price et al.
8,764,931 B2 7/2014 Turner
9,044,063 B2 6/2015 Loverin et al.
9,185,947 B2 11/2015 Spencer et al.
9,273,423 B2 3/2016 Chen
10,151,056 B2 12/2018 Yamazaki
10,321,738 B2 6/2019 Lyke et al.
10,448,706 B2 10/2019 Ho
11,311,079 B2 4/2022 Schaefer et al.
2001/0024709 A1* 9/2001 Yoneda ..... B32B 7/12 442/389
2002/0032955 A1 3/2002 Rasnick et al.
2002/0071946 A1 6/2002 Norton et al.
2002/0124324 A1 9/2002 Widdemer
2002/0172792 A1 11/2002 Jarvis et al.
2002/0172795 A1 11/2002 Gardner et al.
2004/0109960 A1 6/2004 Rydin
2004/0191470 A1 9/2004 Zafiroglu et al.
2006/0218693 A1 10/2006 Sinohui, Jr.
2007/0271823 A1 11/2007 Meschter
2008/0010867 A1 1/2008 Davis, III
2008/0131648 A1 6/2008 Baychar
2009/0214822 A1 8/2009 Crook et al.
2009/0246238 A1 10/2009 Gorman et al.
2009/0280710 A1 11/2009 Zafiroglu

(56) References Cited

U.S. PATENT DOCUMENTS

| | | | |
|---|---|---|---|
| 2010/0077634 | A1 | 4/2010 | Bell |
| 2011/0174204 | A1 | 7/2011 | Berwanger et al. |
| 2012/0144698 | A1 | 6/2012 | Mcdowell |
| 2012/0244310 | A1 | 9/2012 | Visscher |
| 2012/0255201 | A1 | 10/2012 | Little |
| 2013/0004702 | A1 | 1/2013 | Schafer et al. |
| 2013/0255103 | A1 | 10/2013 | Dua et al. |
| 2013/0312284 | A1 | 11/2013 | Berend et al. |
| 2014/0261121 | A1 | 9/2014 | Woodall et al. |
| 2014/0283720 | A1 | 9/2014 | Kawaguchi et al. |
| 2015/0007451 | A1 | 1/2015 | Bruce |
| 2015/0101133 | A1 | 4/2015 | Manz et al. |
| 2015/0157084 | A1 | 6/2015 | Bell et al. |
| 2016/0069006 | A1 | 3/2016 | Dilo |
| 2016/0135543 | A1 | 5/2016 | Anceresi et al. |
| 2016/0194795 | A1 | 7/2016 | Pryne |
| 2017/0202307 | A1 | 7/2017 | Lyke et al. |
| 2017/0202308 | A1 | 7/2017 | Schaefer et al. |
| 2017/0347745 | A1 | 12/2017 | Figur et al. |
| 2018/0103724 | A1 | 4/2018 | Ho |

FOREIGN PATENT DOCUMENTS

| | | | |
|---|---|---|---|
| CN | 202786694 | | 3/2013 |
| CN | 104379099 | | 2/2015 |
| CN | 105050442 | | 11/2015 |
| CN | 105755679 | | 7/2016 |
| CN | 108697190 | A | 10/2018 |
| CN | 110088374 | A | 8/2019 |
| CN | 110177478 | | 8/2019 |
| CN | 110088374 | | 12/2022 |
| CN | 115852598 | | 3/2023 |
| EP | 0717137 | | 6/1996 |
| EP | 1266584 | A1 | 12/2002 |
| EP | 2792261 | A1 | 10/2014 |
| EP | 2818070 | A1 | 12/2014 |
| FR | 463287 | A | 2/1914 |
| FR | 3007317 | A1 | 12/2014 |
| GB | 897782 | A * | 5/1962 |
| JP | H11350328 | | 12/1999 |
| JP | 2003064571 | | 3/2003 |
| JP | 5945050 | B1 | 7/2016 |
| TW | 201629290 | | 8/2016 |
| TW | 201735814 | A | 10/2017 |
| TW | 201735818 | A | 10/2017 |
| VN | 35930 | | 5/2023 |
| VN | 94769 | | 5/2023 |
| WO | WO-2013126475 | A1 | 8/2013 |
| WO | WO-2014182651 | A1 | 11/2014 |
| WO | 2016151969 | | 9/2016 |
| WO | WO-2017127441 | A1 | 7/2017 |
| WO | WO-2017127449 | A1 | 7/2017 |
| WO | WO-2018075429 | A1 | 4/2018 |

OTHER PUBLICATIONS

"European Application Serial No. 17861919.3, Extended European Search Report mailed Aug. 27, 2020", 13 pgs.
"U.S. Appl. No. 15/409,329, Final Office Action mailed Sep. 30, 2020", 39 pgs.
"Chinese Application Serial No. 2017800143810, Office Action mailed Sep. 29, 2020", w English Translation, 30 pgs.
"Chinese Application Serial No. 201780078475.4, Office Action mailed Jan. 14, 2021", w English Translation of the search report, 8 pgs.
"U.S. Appl. No. 15/409,329, Response filed Feb. 26, 2021 to Final Office Action mailed Sep. 30, 2020", 14 pgs.
"U.S. Appl. No. 15/409,329, Non Final Office Action mailed Mar. 16, 2021", 51 pgs.
"European Application Serial No. 17861919.3, Response filed Feb. 23, 2021 to Extended European Search Report mailed Aug. 27, 2020", 15 pgs.
"U.S. Appl. No. 15/409,329, Final Office Action mailed Oct. 18, 2021", 20 pgs.
"Chinese Application Serial No. 201780078475.4, Office Action mailed Sep. 22, 2021", w English Translation, 13 pgs.
"U.S. Appl. No. 15/409,329, Response filed Dec. 2, 2021 to Final Office Action mailed Oct. 18, 2021", 13 pgs.
"Chinese Application Serial No. 201780078475.4, Response filed Nov. 19, 2021 to Office Action mailed Sep. 22, 2021", w English claims, 51 pgs.
"U.S. Appl. No. 15/409,329, Notice of Allowance mailed Dec. 22, 2021", 10 pgs.
"Chinese Application Serial No. 2017800143810, Response filed Dec. 9, 2021 to Office Action mailed Jul. 26, 2021", w/ English claims, 30 pgs.
"Taiwanese Application Serial No. 106101971, Response filed Feb. 15, 2022 to First Office Action mailed Aug. 12, 2021", w English claims, 31 pgs.
"U.S. Appl. No. 15/409,329, Corrected Notice of Allowability mailed Mar. 23, 2022", 2 pgs.
"Vietnam Application Serial No. 1-2019-02587, Examination Report mailed Mar. 21, 2022", w English Translation, 3 pgs.
"Chinese Application Serial No. 201780078475.4, Response filed Mar. 24, 2022 to Office Action mailed Jan. 25, 2022", w English claims, 14 pgs.
"Vietnam Application Serial No. 1-2019-02587, Response filed Apr. 22, 2022 to Examination Report mailed Mar. 21, 2022", With English claims, 8 pgs.
"Chinese Application Serial No. 202211473165.1, Voluntary Amendment filed Jun. 28, 2023", w English claims, 18 pgs.
"Chinese Application Serial No. 2017800143810, Response filed Apr. 14, 2021 to Office Action mailed Sep. 29, 2020", w English claims, 23 pgs.
"Chinese Application Serial No. 201780078475.4, Response filed Apr. 27, 2021 to Office Action mailed Jan. 14, 2021", w English claims, 19 pgs.
"Taiwanese Application Serial No. 106101971, Response to Examiner Telephone Interview filed Nov. 1, 2022", w English claims, 30 pgs.
U.S. Appl. No. 15/409,329, filed Jan. 18, 2017, Footwear With Felting Transition Between Materials.
U.S. Appl. No. 15/589,641, filed May 8, 2017, Systems and Methods for Manufacturing Footwear With Felting.
"Chinese Application Serial No. 201780078475.4, Office Action mailed Jul. 9, 2021", With English translation, 23 pages.
"Chinese Application Serial No. 2017800143810, Office Action mailed Jul. 26, 2021", With English translation, 23 pages.
"Taiwanese Application Serial No. 106101971, First Office Action mailed Aug. 12, 2021", With English translation, 7 pages.
"U.S. Appl. No. 15/409,329, Response filed Sep. 8, 2021 to Non Final Office Action mailed Mar. 16, 2021", 14 pages.
"Chinese Application Serial No. 201780078475.4, Response filed Sep. 7, 2021 to Office Action mailed Jul. 9, 2021", With English claims, 18 pages.
U.S. Appl. No. 15/589,641 U.S. Pat. No. 10,448,706, filed May 8, 2017, Systems and Methods for Manufacturing Footwear With Felting.
"AMS-221 EN / IP-420 Instruction Manual. No. 02. 40135402", SanDisk Corporation, (Oct. 2016), 122 pgs.
"U.S. Appl. No. 15/409,311, Non Final Office Action mailed Oct. 9, 2018", 13 pgs.
"U.S. Appl. No. 15/409,311, Notice of Allowance mailed Feb. 6, 2019", 7 pgs.
"U.S. Appl. No. 15/409,311, Response filed Jan. 9, 2019 to Non Final Office Action mailed Oct. 8, 2018", 11 pgs.
"U.S. Appl. No. 15/409,311, Response filed Sep. 17, 2018 to Restriction Requirement mailed Jul. 23, 2018", 7 pgs.
"U.S. Appl. No. 15/409,311, Restriction Requirement mailed Jul. 23, 2018", 4 pgs.
"U.S. Appl. No. 15/409,329, Response filed May 3, 2019 to Restriction Requirement mailed Feb. 6, 2019", 8 pgs.
"U.S. Appl. No. 15/409,329, Restriction Requirement mailed Feb. 6, 2019", 6 pgs.

(56) References Cited

OTHER PUBLICATIONS

"U.S. Appl. No. 15/409,329, Restriction Requirement mailed Aug. 20, 2019", 6 pgs.
"U.S. Appl. No. 15/589,641, Examiner Interview Summary mailed May 13, 2019", 4 pgs.
"U.S. Appl. No. 15/589,641, Non Final Office Action mailed Feb. 25, 2019", 17 pgs.
"U.S. Appl. No. 15/589,641, Notice of Allowance mailed Jun. 12, 2019", 6 pgs.
"U.S. Appl. No. 15/589,641, Response filed May 28, 2019 to Non Final Office Action mailed Feb. 25, 2019", 15 pgs.
"U.S. Appl. No. 15/589,641, Response filed Dec. 4, 2018 to Restriction Requirement mailed Sep. 27, 2018", 8 pgs.
"U.S. Appl. No. 15/589,641, Restriction Requirement mailed Sep. 27, 2018", 7 pgs.
"U.S. Appl. No. 16/408,909, Preliminary Amendment filed Jun. 11, 2019", 6 pgs.
"European Application Serial No. 17702251.4, Response filed Mar. 11, 2019 to Communication Pursuant to Rules 161 and 162 mailed Aug. 31, 2018", 27 pgs.
"European Application Serial No. 17702253.0, Response filed Mar. 11, 2019 to Communication Pursuant to Rules 161 and 162 mailed Aug. 30, 2018", 18 pgs.
"International Application Serial No. PCT/US2017/013964, International Preliminary Report on Patentability mailed Aug. 2, 2018", 10 pgs.
"International Application Serial No. PCT/US2017/013964, International Search Report mailed Apr. 5, 2017", 5 pgs.
"International Application Serial No. PCT/US2017/013964, Written Opinion mailed Apr. 5, 2017", 8 pgs.
"International Application Serial No. PCT/US2017/013975, International Preliminary Report on Patentability mailed Aug. 2, 2018", 8 pgs.
"International Application Serial No. PCT/US2017/013975, International Search Report mailed Apr. 19, 2017", 4 pgs.
"International Application Serial No. PCT/US2017/013975, Written Opinion mailed Apr. 19, 2017", 6 pgs.
"International Application Serial No. PCT/US2017/056851, International Preliminary Report on Patentability mailed May 2, 2019", 12 pgs.
"International Application Serial No. PCT/US2017/056851, International Search Report mailed Feb. 7, 2018", 3 pgs.
"International Application Serial No. PCT/US2017/056851, Written Opinion mailed Feb. 7, 2018", 10 pgs.
"U.S. Appl. No. 15/409,329, Response filed Dec. 6, 2019 to Restriction Requirement mailed Aug. 20, 2019", 7 pgs.
"European Application Serial No. 17861919.3, Response to Communication Pursuant to Rules 161 162 filed Dec. 10, 2019", 11 pgs.
"U.S. Appl. No. 15/409,329, Non Final Office Action mailed Mar. 17, 2020", 36 pgs.
"Abutt", Dictionary.com, [Online] Retrieved from the internet:https: www.dictionary.com browse abut, 1 pg.
"European Application Serial No. 17861919.3, Partial supplementary European search report mailed May 26, 2020", 13 pgs.
"Chinese Application Serial No. 201780078475.4, Office Action mailed Jun. 6, 2022", With English machine translation, 13 pgs.
"European Application Serial No. 17861919.3, Communication Pursuant to Article 94(3) EPC mailed Jul. 6, 2022", 6 pgs.
"Chinese Application Serial No. 201780078475.4, Response filed Aug. 2, 2022 to Office Action mailed Jun. 6, 2022", w English Claims, 15 pgs.
"European Application Serial No. 17861919.3, Response filed Oct. 10, 2022 to Communication Pursuant to Article 94(3) EPC mailed Jul. 6, 2022", 27 pgs.
"European Application Serial No. 17861919.3, Response filed Aug. 2, 2024 to Communication Pursuant to Article 94(3) EPC mailed Apr. 11, 2024", 16 pgs.

* cited by examiner

SYSTEMS AND METHODS FOR MANUFACTURING FOOTWEAR WITH FELTING

CLAIM OF PRIORITY

This application is a divisional application of U.S. patent application Ser. No. 15/589,641, filed May 8, 2017, which application claims the benefit of priority to U.S. Provisional Patent Application Ser. No. 62/409,735, filed on Oct. 18, 2016, the contents of both which are incorporated herein by reference in their entireties.

BACKGROUND

The present disclosure relates generally to, but not by way of limitation, devices, systems and methods for connecting pieces of material that can be used in clothing, footwear and the like. In an exemplary application, the present disclosure relates to the construction of uppers for articles of footwear that include felting.

Shoe uppers are typically fabricated from a plurality of different materials in order to provide different performance characteristics at different locations on the shoe. For example, it might be desirable for the shoe to be breathable near the toes to allow perspiration to escape, but more rigid at the heel to keep the shoe attached to the foot during use. Thus, a shoe might incorporate a fabric mesh panel near the toe cap and a reinforced polymer panel near the heel cap. Other materials used in footwear may be relatively flexible and tough such as those used near the metatarsophalangeal (MTP) joint between the metatarsal bones of the foot and the proximal phalanges of the toes where repeated bending occurs. Thus, a shoe might incorporate a panel made of leather, vinyl or the like at the vamp.

In order to accommodate the different sizes, shapes and materials used in the panels of shoe uppers, a variety of seaming and joining methods are typically used. Lap joints and butt joints have conventionally been used, as is described in U.S. Pat. No. 2,235,694 to Wolfhard et al. U.S. Pat. No. 6,743,519 to Widdemer describes supplementary fiber structures for leather. Felt, felting or needle punching have been described generally as being used in articles of footwear in U.S. Pat. No. 7,347,011 to Dua et al., U.S. Pat. No. 8,731,696 to Jones et al., U.S. Pub. No. 2012/0255201 to Little and U.S. Pub. No. 2015/0101133 to Manz et al.

Overview

The present inventors have recognized the need for articles of footwear having uppers that include felting to be durable and rugged, comfortable and aesthetically pleasing. The present subject matter can help provide a solution to this problem by providing an upper for an article of footwear that includes felting seams that are not excessively thick or bulky, that provide adequate strength between panels of material of the upper, and that can be made in an aesthetically pleasing pattern.

Furthermore, the present inventors have recognized, among other things, that conventional felting or needle punching machines are typically large systems that are configured for bulk processing of textiles, typically by moving a large piece, such as from a roll, linearly through the machine. Thus, it can be difficult or impossible for conventional felting machines to produce highly customized, unique or non-repeating patterns. Another problem with conventional felting machines is the lack of a needle punching head having a high density of needles. This can result in conventional felting machines having to spend a significant amount of time in producing a felting pattern of a desired density.

The present subject matter can help provide a solution to these problems, such as by providing a felting or needle punching machine that is capable of felting along a highly customized, non-repeating felting pattern with a needle head having a needle density that can help reduce manufacturing times. For example, a needle punching machine can include a stitching jig having a multi-row and multi-column matrix of felting needles. The stitching jig can be reciprocated relative to a feeding frame that can move along a multi-direction feed path, such as via a computer programmable actuation mechanism that controls a felting path of the stitching jig.

In an example, a needle assembly for a stitching machine can comprise: a stitching jig comprising a needle holder, a needle clamp hoop and a fixing jig. The needle holder can have a plurality of needle sockets configured to hold a plurality of needles. The needle clamp hoop can be connected to the needle holder to retain needles in the plurality of sockets. The fixing jig can be connected to the needle clamp hoop configured to couple with a reciprocating bar of the stitching machine.

In an example, a needle punching machine can comprise: a punching bar, a presser bar, a stitching jig, a presser foot and a hook cover plate. The punching bar can be connected to the needle punching machine and configured to be reciprocated. The presser bar can be connected to the needle punching machine and configured to be locked into a stationary disposition. The stitching jig can comprise a fixing jig coupled to the punching bar, and a needle holder having a plurality of sockets. The presser foot can comprise a lifter coupled to the presser bar, and a plurality of through-bores configured to align with the plurality of sockets. The hook cover plate can be connected to the needle punching machine opposite the presser foot. The hook cover plate can include a plurality of holes configured to align with the plurality of sockets and the plurality of through-bores.

In an example, a method of manufacturing a shoe upper can comprise: positioning a first sheet of material for a shoe upper adjacent a hook cover plate including a first matrix of holes; positioning a second sheet of material for the shoe upper to at least partially overlap with the first sheet of material at an overlap adjacent the plurality of holes; reciprocating a stitching jig to repetitively advance a plurality of barbed needles arranged in a second matrix matching the first matrix through the overlap of first and second sheets of material and into the plurality of holes; and translating the first and second sheets of material to move the overlap along the first matrix of holes.

In an example, a method for manufacturing an upper for an article of footwear can comprise: laying out a first sheet of material; positioning a second sheet of material to at least partially overlap with the first sheet of material at an overlap; positioning a felt material adjacent the overlap so that the second sheet of material is at least partially between the first sheet of material and the felt material; and felting the felt material to draw fibers of the felt material through the first and second sheets of material to join the first and second sheets of material at a felting seam.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

FIG. 11F is a plan view of the outside of the shoe upper layers of FIG. 11E after cutting to a refined shoe upper shape.

Figure 1:
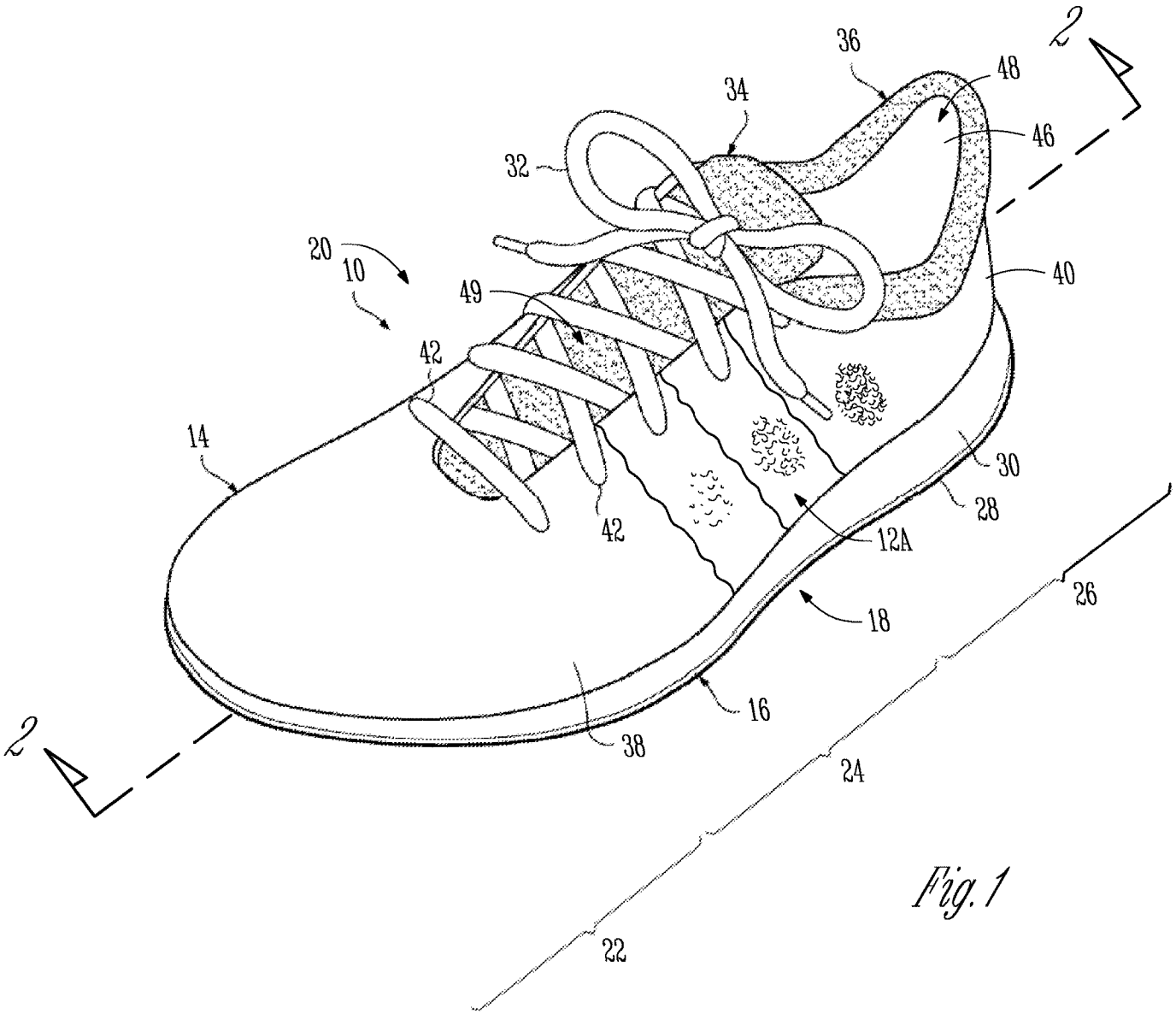
FIG. 1 is a perspective view of a lateral side of an article of footwear having an upper with two panels joined by a felting stitch of the present disclosure.

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

FIG. 1 is a perspective view of article of footwear 10 having felting 12A on upper 14, which is connected to sole structure 16. Article of footwear 10 includes lateral side 18 and medial side 20 having felting 12A and 12B (FIG. 2), respectively. Article of footwear 10 can also include forefoot region 22, midfoot region 24, and heel region 26. Sole structure 16 can include outsole 28 and midsole 30. Upper 14 can include lace 32, tongue 34 and collar element 36. Upper 14 can be comprised of a plurality of panels of different or identical type of material, such as toe panel 38 and heel panel 40. Various panels of upper 14 can be connected to each other via felting 12A.

In the example shown, upper 14 includes toe panel 38 and heel panel 40 that together at least partially surround a foot. Each of toe panel 38 and heel panel 40 can wrap, at least partially, around medial and lateral sides of upper 14. For example, toe panel 38 can form a vamp for footwear 10, extending from the lateral MTP joint area of the foot, around the toe cap of footwear 10, and to the medial metatarsophalangeal (MTP) joint area of the foot. Likewise, heel panel 40 can form a heel counter and quarters for footwear 10, extending from the lateral midfoot area of the foot, around the heel cap of footwear 10, and to the medial midfoot area of the foot. Collectively, panels 38 and 40, along with other parts of footwear 10, form a housing when joined to sole structure 16 for at least partially enclosing the foot. Upper 14 can include apertures 42, insole 44 (FIG. 2), lining 46 and foot space 48. Components of upper 14, including tongue 34, collar element 36, toe panel 38 and heel panel 40, can be formed of various materials, such as knitted, woven, natural or synthetic materials. Toe panel 38 and heel panel 40 can be comprised of one or more sub-panels. Each panel 38 and 40 and sub-panel of footwear 10 can be joined together using conventional stitching and seaming structures and methods. Additionally, as described herein, various panels and sub-panels can be joined using a felting stitch that results in a felting pattern or "felting" that can indirectly or directly link the panels 38 and 40 together such as via a backing panel.

In the example, shown, felting 12A extends across anterior-posterior ends or edges of toe panel 38 and heel panel 40. The ends or edges of toe panel 38 and heel panel 40 can be arranged in an abutting or overlapping relationship. Felting 12A can form a junction therebetween to mechanically interlock panels 38 and 40, thereby reducing or eliminating the need for separate strengthening stitching that directly links panel 38 and panel 40. Additionally, felting 12A can have different densities on the materials of panels 38 and 40 to provide varying levels of frictional interlock, as discussed in greater detail below. Felting 12A can have a gradient to provide a transition between the colors, textures and materials, and combinations thereof, of panels 38 and 40. Furthermore, felting 12A can be shaped to provide aesthetic aspects to footwear 10. The structure, shape and density of felting 12A can be controlled and fabricated using the stitching machine and multi-needle felting assembly of FIGS. 5A-8 described herein.

Forefoot region 22 generally includes portions of footwear 10 corresponding with the toes and the joints connecting the metatarsals with the phalanges (the MTP joints). Midfoot region 24 generally includes portions of footwear 10 corresponding with the arch area of the foot. Heel region 26 generally corresponds with the heel area of the foot, including the calcaneus bone. Lateral side 18 and medial side 20 extend through each of regions 22-26 in an anterior-posterior direction. Regions 22-26 and sides 18 and 20 are not intended to demarcate precise areas of footwear 10. Rather, regions 22-26 and sides 18 and 20 are intended to represent general areas of footwear 10 to aid in the discussion of footwear 10.

Felting of the present disclosure, such as felting 12A and B, can be located in various places and in various orientations in each of the regions and sides of footwear 10. It can, however, be desirable to position felting away from high stress points of footwear 10. For example, it can be desirable to position felting away from the MTP joint to avoid stressing the felting fibers due to the repeated bending of the foot. In the example described herein, felting 12A is located along the tarsals, posterior of the MTP joint, and felting 12B is located along the instep of the foot, posterior of the MTP joint. Felting can additionally or alternatively be located on the distal superior surface of toe panel 38, on the posterior surface of heel panel 40, on tongue 34 and other locations throughout footwear 10. However, it is contemplated that the stitching machine and multi-needle felting assembly of FIGS. 5A-8 described herein can provide stitching strong enough to be applied to a high stress region of upper 14, such as the MTP joint area, without experiencing premature degradation.

Tongue 34 can be connected to toe panel 38 and can extend under lace 32 to enhance the comfort and adjustability of footwear 10. Tongue 34 can extend between opposing portions of toe panel 38 and opposing portions of heel panel 40. Opposing portions of heel panel 40 can be fitted with collar element 36. Collar element 36 is located in at least heel region 26. Collar element 36 and tongue 34 form an opening for providing an access point for a foot into the interior of upper 14. Lace 32 extends through various lace apertures 42 and across throat area 49 of upper 14 to permit a wearer of footwear 10 to modify dimensions of upper 14 and accommodate the proportions of the foot. Lace 32 can operate in a generally conventional manner to tighten upper 14 around the foot when lace 32 is cinched, thereby shrinking the size of foot space 48 of the housing formed by panels 38 and 40. When lace 32 is loosened, upper 14 is also loosened to enlarge the size of foot space 48 of the housing. Footwear 10 can alternatively be provided with other types of fastening systems, such as electronic, elastic, hook and loop fastener and similar systems.

A foot of a wearer of footwear 10 can rest on sole structure 16, while upper 14 surrounds the foot to maintain the foot inserted into footwear 10. Sole structure 16 is secured to upper 14 and extends between the foot and the ground when footwear 10 is worn. Midsole 30 is secured to lower portions of upper 14 and can be secured to upper 14 by adhesive, stitching or other suitable means.

Suitable materials for midsole 30 include polymer foam materials such as ethylvinylacetate or polyurethane, or any other material that compresses resiliently so as to attenuate ground reaction forces (i.e., provide cushioning) when compressed between the foot and the ground during walking, running, or other ambulatory or athletic activities associated with a human gait or movement of the foot.

Insole 44 (FIG. 2) can typically comprises a removable insert disposed atop midsole 30, and can provide additional cushioning or ventilation (e.g. by including perforations). Insole 44 can be located within upper 14 and is positioned to extend under a lower or inferior surface of the foot.

Outsole 28 is secured to a lower surface of midsole 30 and may be formed from a wear-resistant rubber material that is textured to impart traction. Outsole 28 can be attached to the lower surface of midsole 30 by adhesive or other suitable means. Suitable materials for outsole 28 include polymers, e.g., polyether-block co-polyamide polymers (sold as Pebax® by ATOFINA Chemicals of Philadelphia, Pa.), and nylon resins such as Zytel®, sold by Dupont. Other suitable materials for outsole 28 and midsole 30 can also be used as are known in the art. Outsole 28 can include various features for providing traction, such as lugs and ribs.

Midsole 30 may incorporate fluid-filled chambers, plates, moderators, or other elements that further attenuate forces, enhance stability, or influence motions of the foot, or midsole 30 may be primarily formed from a fluid-filled chamber. An air bladder can comprise two plies of polymeric membrane, as is described in U.S. Pat. No. 5,802,739 to Potter et al. In another example, a four-ply air bladder can be used, as is described in U.S. Pat. No. 6,402,879 to Tawney et al. In yet another example, a fabric cushioning element can be used, as is described in U.S. Pat. 8,764,931 to Turner. The entire contents of U.S. Pat. Nos. 5,802,739; 6,402,879; and 8,764,931 are hereby incorporated in their entirety by this reference for all purposes. In yet other examples, a bladder may be filled with other gases, such as nitrogen, helium or so-called dense gases such as sulfur hexafluoride, a liquid, or gel.

Upper 14 and sole structure 16 can be configured to enhance the appearance, comfort and performance of footwear during a variety of activities. Although the present description is written with reference to a general purpose athletic shoe, the disclosure of the present application can be applied equally to other types of footwear, such as, but not limited to, dress shoes, running shoes, leisure shoes, fashion shoes, golf shoes, football cleats, soccer cleats, baseball cleats, tennis shoes, sandals, boots, slippers and the like. Additionally, the disclosure of the present application may be used in other articles of manufacture including textiles, articles of apparel and articles of clothing.

Figure 2:
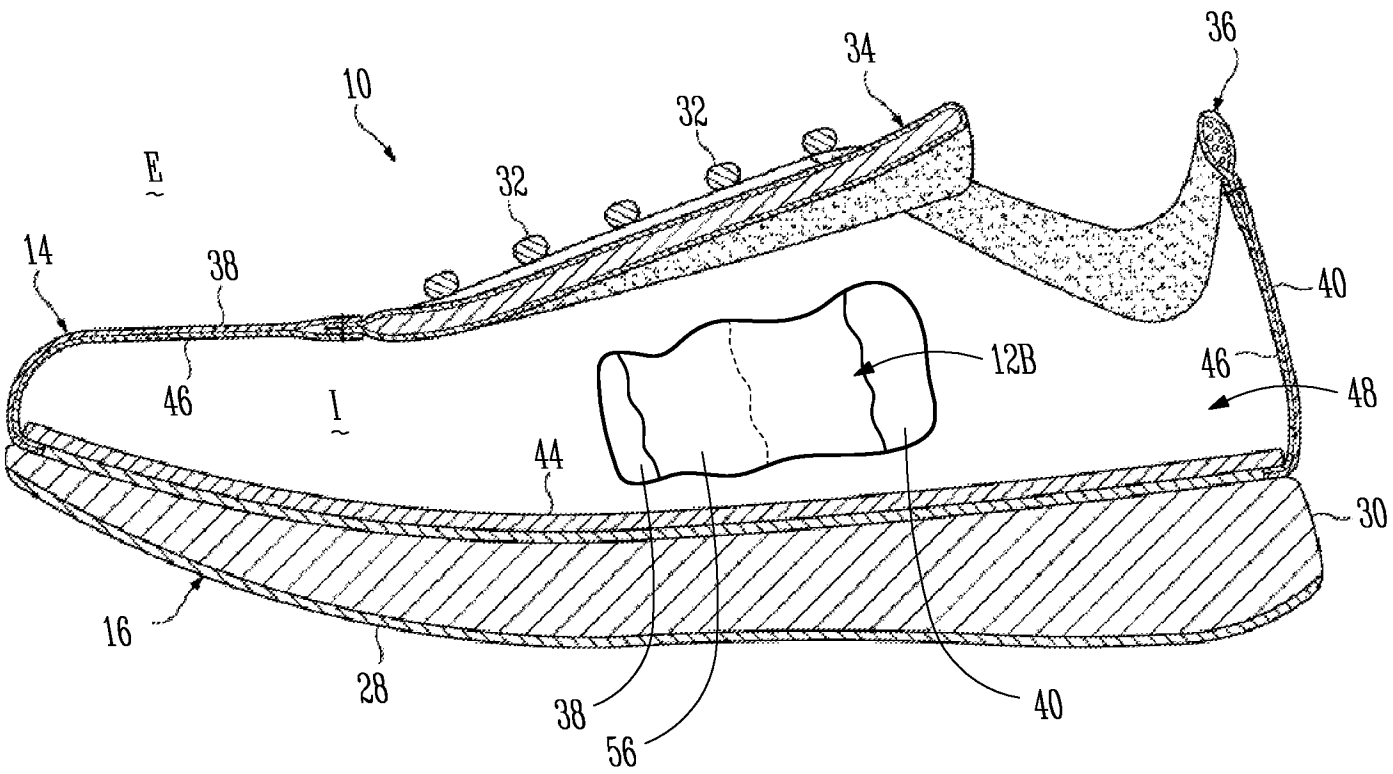
FIG. 2 is a cross-sectional view of the article of footwear of FIG. 1 taken along a toe-to-heel cut to show an internal foot space.

FIG. 2 is a cross-sectional view of article of footwear 10 of FIG. 1 taken along a toe-to-heel cut to show insole 44 and lining layer 46 within internal foot space 48. A portion of lining layer 46 is broken away in FIG. 2 to show felting 12B on an interior side of toe panel 38 and heel panel 40.

Upper 14 is formed from various layers including those formed by toe panel 38 and heel panel 40 that combine to provide a structure for securely and comfortably receiving a foot. Although the configuration of upper 14 may vary significantly, the various elements generally define a void within footwear 10 for receiving and securing the foot relative to sole structure 16 within foot space 48. Additionally, upper 14 can include internal layers, such as lining layer 46. Lining 46 can provide a smooth, aesthetically appealing, comfortable surface within foot space 48 for the foot and can line the entirety or most of upper 14 in foot space 48. Panels 38 and 40 form at least a portion of an exterior surface of upper 14. Lining layer 46 forms at least a portion of an interior surface of upper 14, i.e., the surface defining foot space 48.

Panels 38 and 40 and lining layer 46 may be formed from a variety of materials (e.g., textiles, fabrics, polymer foam, leather, synthetics) that can be stitched, bonded or felted together. As an example, panel 38 can be formed of a smooth material, such as leather or a synthetic material, while panel 40 can be formed of a breathable material, such as a mesh, woven or knitted material. In many conventional shoes, panels of starkly contrasting materials adjoin at edges that form distinct lines. Those lines can be covered with various foxing, striping, piping or webbing, but those items themselves can leave sharply visible edge lines and add potentially undesirable thickness and stiffness to the shoe. Upper 14 of footwear 10 can, however, include foxing, striping, piping or webbing.

Felting 12A can be configured to provide a comfortable, aesthetically pleasing joint between toe panel 38 and heel panel 40. Felting 12A can include backing panel 56, which can be located in the interior I of upper 14 in foot space 48. Backing panel 56 provides a material having fibers that can be extended into toe panel 38 and heel panel 40, such as by using the stitching machine and multi-needle felting assembly of FIGS. 5A-8 described herein. For example, fibers of backing panel 56 can be pushed or pulled through toe panel 38 and heel panel 40 using barbed needles to the exterior E of footwear 10. The displaced fibers of backing panel 56 remain connected to backing panel 56 to interlock each of toe panel 38 and heel panel 40 with backing panel 56. The portions of the fibers extended out to the exterior E can affect the feel and look of upper 14.

Figure 3:
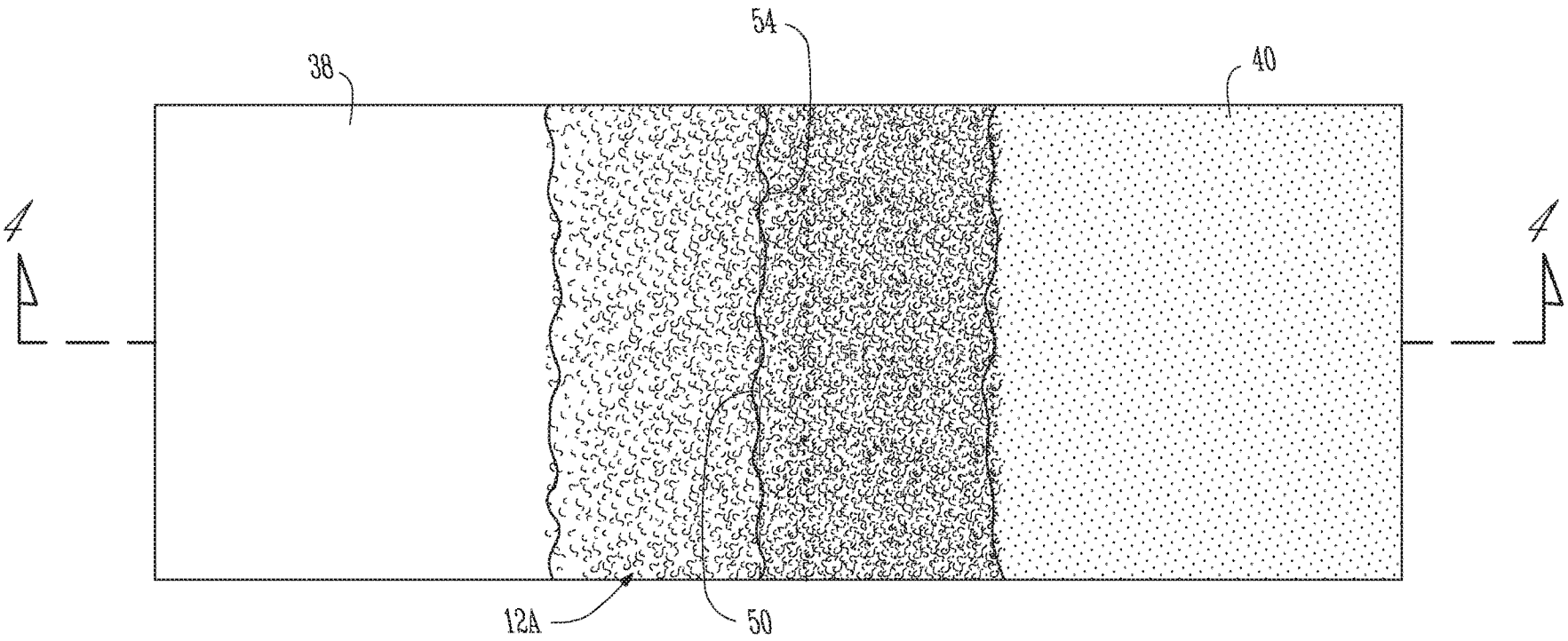
FIG. 3 is a schematic view of a first panel and a second panel of an upper for an article of footwear joined by a felting stitch.

FIG. 3 is a schematic view of toe panel 38 and heel panel 40 of upper 14 for article of footwear 10 joined by felting 12A. Felting 12A comprises fibers of a backing panel, e.g. backing panel 56 of FIG. 4, that are pushed or pulled, so as to extend, through toe panel 38 and heel panel 40 to interlock the panels of upper 14 with backing panel 56, thereby linking panels 38 and 40 of upper 14 to each other.

Figure 4:
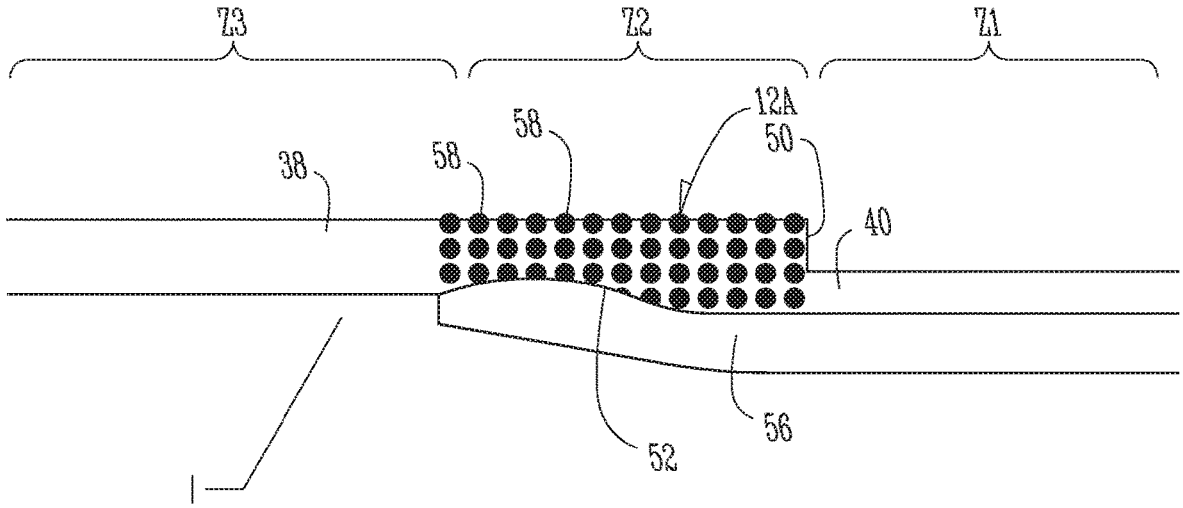
FIG. 4 is a schematic cross-sectional view of the felting stitch of FIG. 3 showing an embodiment where a felting material is pressed through overlapping upper panels.

In the example of FIG. 3, toe panel 38 and heel panel 40 are positioned in an overlapping relationship such that posterior edge 50 of toe panel 38 overlaps anterior edge 52 of heel panel 40, as can be seen in FIG. 4. Portions of toe panel 38 and heel panel 40 near posterior edge 50 and anterior edge 52 can be joined by stitch 54. Stitch 54 comprises an initial connection between toe panel 38 and heel panel 40 that provides immobilization between the two panels in order to allow the felting process to take place. In other examples, stitch 54 is omitted. Stitch 54 may comprise a single fiber or strand having a zigzag shape. In yet other examples, a stitch having a different shape or different number of strands can be used. For example, a smoothly curved stitch or a two- or three-strand stitch may be used. However, the fastening provided by stitch 54, or its alternatives, need not provide the main securing force between panels 38 and 40 as can be provided by felting 12A.

Felting 12A simultaneously provides mechanical coupling between panels 38 and 40 and a customizable, aesthetically variable arrangement or pattern on upper 14. In the example of FIG. 3, felting 12A forms a gradient between panels 38 and 40 that provides a linear change in the density of felting 12A from panel 38 to panel 40. Thus, felting 12A can provide a transition between panel 38 and panel 40 that softens the hard edge formed at the juncture of posterior edge 50 and anterior edge 52. Felting 12A can also be used to provide an aesthetically pleasing transition between toe panel 38 and heel panel 40, such as a bleed pattern. In the example of FIGS. 3 and 4, the density of felting 12A trails off, or becomes reduced in density as it extends from heel panel 40 into toe panel 38. As such, backing panel 56 can match the color or material of heel panel 40 and felting 12A can appear to simulate a fading of heel panel 40 into toe panel 38.

FIG. 4 is a cross-sectional view of felting 12A of FIG. 3 showing an embodiment where backing panel 56 is positioned along an interior I of toe panel 38 and heel panel 40. Backing panel 56 includes fibers 58 that extend through to an exterior E of toe panel 38 and heel panel 40. The extension of fibers 58 through panels 38 and 40 can be produced utilizing the systems, machines, tools and devices described below with reference to FIGS. 5-8.

The dimensions, e.g. thicknesses, of panels 38 and 40 and backing panel 56 are, unless otherwise specified, not drawn to scale and are exaggerated for illustrative purposes. Together, toe panel 38, heel panel 40 and backing panel 56 combine to provide upper 14 with a plurality of zones on exterior E of footwear 10. In the example of FIG. 4, zones Z1 through Z3 are shown, each zone having a different material and felting combination.

In the example shown, backing panel 56 is positioned directly against major surfaces of toe panel 38 and heel panel 40 within the interior I, with toe panel 38 and heel panel 40 partially overlapping. Fibers 58 of backing panel extend through toe panel 38 and heel panel 40. Tips and loop-ends of fibers 58 extend beyond an exterior E of toe panel 38 and heel panel 40 in order to provide a visual and tangible finish to major surfaces of panels 38 and 40 from the exterior E. As such, backing panel 58 can be fabricated from a material that is made of a plurality of fibers or strands, or a jumbled mesh of a single strand or fiber or multiple strands or fibers. In examples, backing panel 58 can comprise a panel fabricated from a plurality of densely packed fibers, such as felt or wool. In examples, a width of backing panel 56 can be wider than felting 12A, as shown in FIG. 4. In other examples, the width of backing panel 56 can be approximately the same width as felting 12A. In additional examples, backing panel 56 can extend across an entirety of, or a substantial portion of, the interior surfaces of upper 14. In such an example, backing panel 56 can, but need not, act as or replace lining 46.

In an example, panels 38 and 40 have different color and texture. For example, panel 38 can comprise leather and panel 40 can comprise wool fabric. In such an example, backing panel 56 can comprise a felt having the color of heel panel 40. In an example, zone Z1 comprises a heel region where upper 14 has the appearance of unfelted material of heel panel 40. Thus, in the example of FIGS. 3 and 4, heel panel 40 comprises unfelted wool fabric. Zone Z2 comprises a toe region where upper 14 has the appearance of felted material of toe panel 38. Thus, in the example of FIGS. 3 and 4, toe panel 38 comprises a region of felted leather. Zone Z3 comprises a toe region where upper 14 has the appearance of unfelted material of toe panel 38. Thus, in the example of FIGS. 3 and 4, toe panel 38 comprises unfelted leather. Other zones could be included in upper 14. For example, fibers of backing 38 could be extended through heel panel 40 to produce a zone where a heel region of upper 14 has the appearance of felted material of heel panel 40. Thus, in the example of FIGS. 3 and 4, heel panel 40 may include a felted wool fabric zone between zone 1 and zone 2.

Additionally, the degree, density or amount of felting, e.g. the quantity of fibers 58 from backing panel 56 extending through the material of upper 14, can depend on the density of needles used in a stitching machine (e.g., stitching machine 80 discussed below) or the pattern that the stitching machine makes relative to upper 14. The stitching machine can be configured to provide different densities of felting. For example, a higher density of felting can be provided in zone 2 near heel panel 40 so the felting appears similar to the texture of heel panel 40, and a lower density of felting can be provided in zone 2 near toe panel 38 so the felting appears similar to the texture of toe panel 38 (as is illustrated in FIG. 3).

Felting 12A described thus far, as well as other felting shapes, patterns, designs and structures can be produced using the stitching machine and multi-needle felting assembly of FIGS. 5A-8 described below.

Figure 5A:
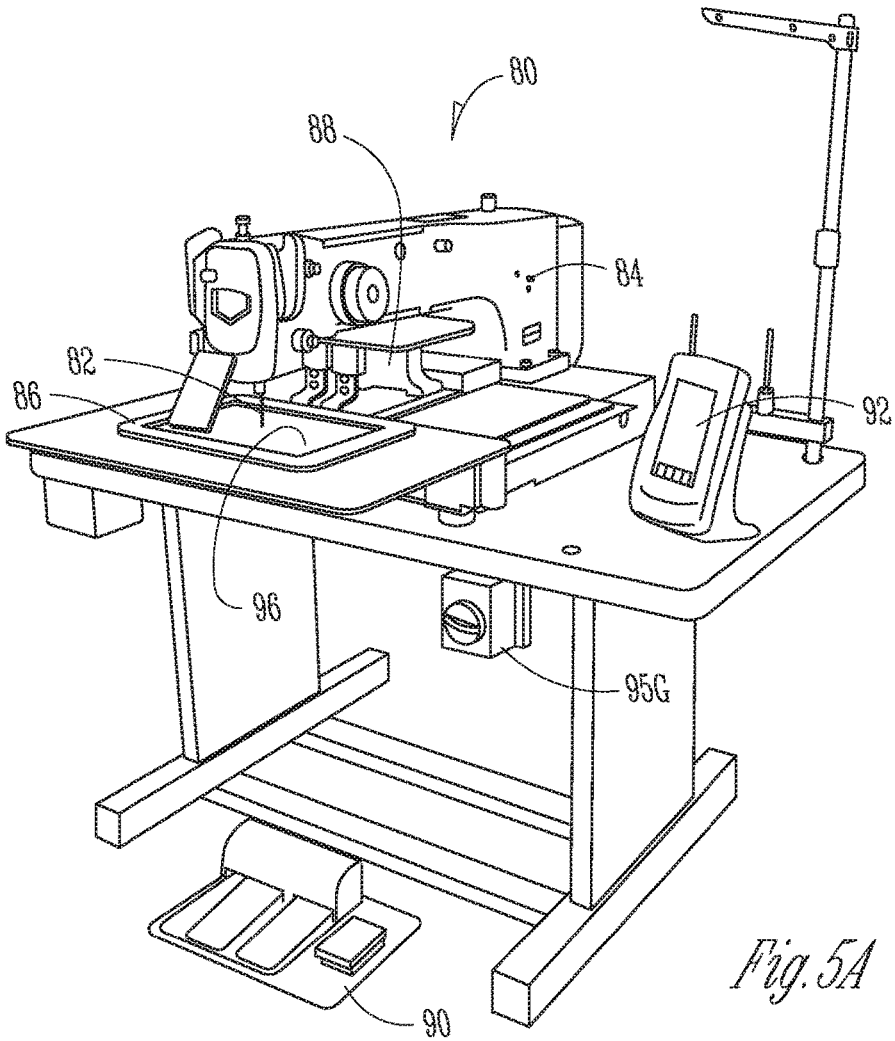
FIG. 5A is a perspective view of a stitching machine in which an automated feeding frame and a multi-needle felting assembly of the present disclosure is used.
Figure 5B:
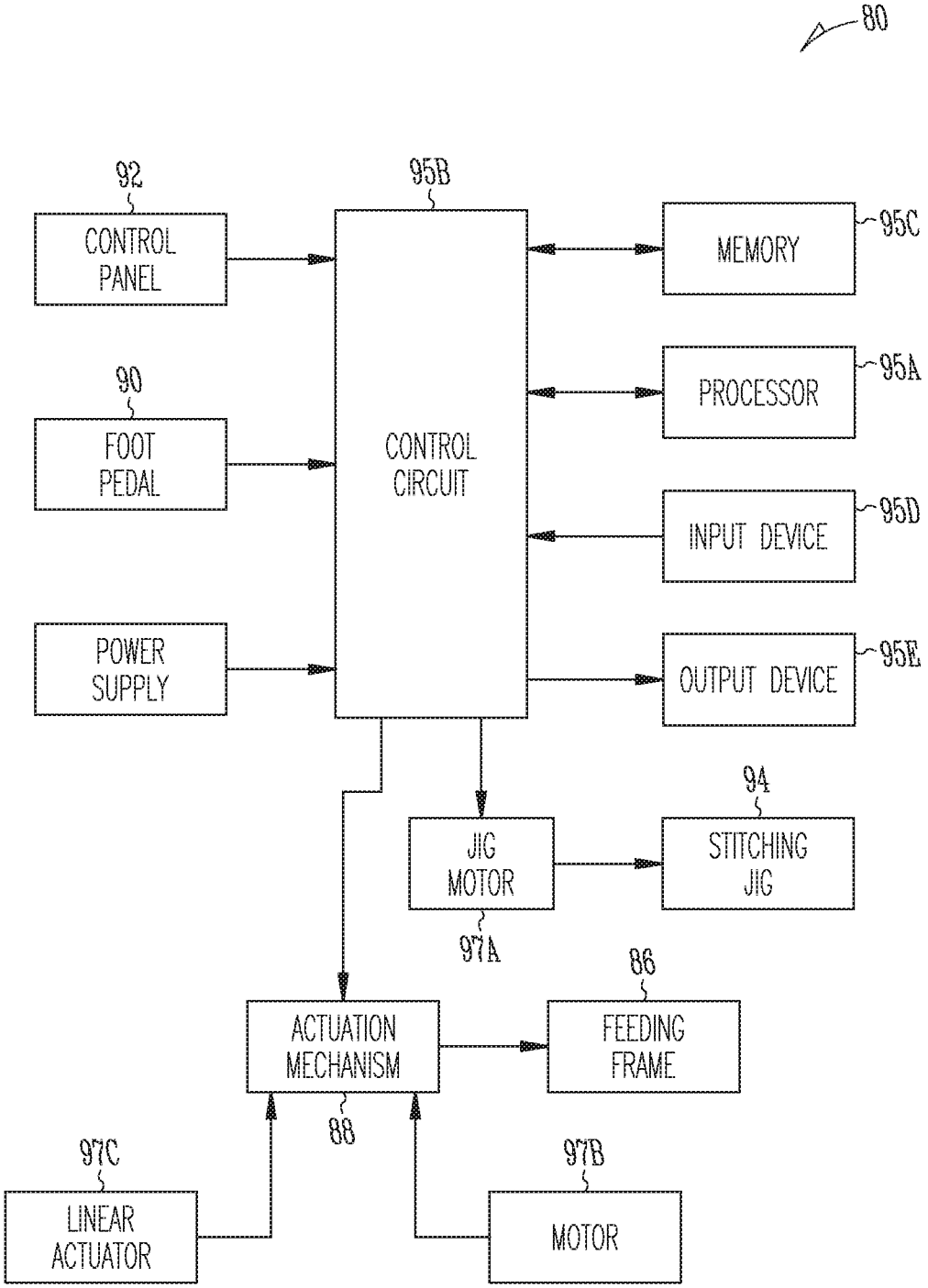
FIG. 5B is a schematic of the stitching machine of FIG. 5A showing various components for control and automation of the feeding frame and the multi-needle felting assembly.

FIG. 5A is a perspective view of stitching machine 80 in which multi-needle felting assembly 82 of the present disclosure can be used. Stitching machine 80 can include housing 84, feeding frame 86, actuation mechanism 88, foot pedal 90 and control panel 92. Multi-needle felting assembly 82 can include stitching jig 94 and cover plate 96. FIG. 5B is a schematic of stitching machine 80 of FIG. 5A showing various components for control and automation of feeding frame 85 and multi-needle felting assembly 82, such as motor 97A and motor 97B. FIGS. 5A and 5B are discussed concurrently.

Housing 84 can include motor 97A (FIG. 5B) that can cause reciprocation of components of stitching machine 80. For example, stitching jig 82 can be mounted to a punching bar 100 (FIG. 6) that causes a block of felting needles to reciprocate through holes in cover plate 96. Motor 97A can be activated by foot pedal 90. A material component, such as a footwear upper or the like, can be connected to feeding frame 86 in order to receive stitching from stitching jig 82. Feeding frame 86 can be moved by actuation mechanism 88 in order to move different portions of the material component relative to stitching jig 82 and cover plate 88. Actuation mechanism 88 can include various components to move feeding frame 86, such as motor 97B, actuator 97C, drives, belts, gears, pulleys and the like. For example, stitching jig 82 can be configured to move in an up and down manner along an X axis, while actuation mechanism 88 can be configured to move or translate feeding frame 86 along a Y axis and a Z axis that are perpendicular to the X axis. As such, feeding frame 86 can direct a 2-dimensional felting pattern to me made on the material component loaded into feeding frame 86 while stitching jig 82 is reciprocated into and out of the material component perpendicular to the 2-dimensional felting pattern. Thus, feeding frame 86 can direct a multi-directional felting path for the material component. Control panel 92 can be used to program stitching machine 80 to move feeding frame 86 through various patterns to provide stitching or felting along different paths and densities on the material component. Stitching machine 80 can thus include various computer elements for receiving, storing and reading programming instructions, such as microprocessors 95A, a control circuit or central processing units (CPUs) 95B, memory 95C, input devices (e.g., a keypad) 95D, output devices (e.g., a monitor) 95E, a power supply 95F, a power switch 95G and the like, as shown in FIG. 5B. In an example, stitching machine 80, except for stitching jig 94 and cover plate 96, can comprise an AMS-221EN-3020 sewing machine commercially available from JUKI Corporation. For example, the aforementioned commercially available sewing machine can be operated with stitching jig 94 and cover plate 96 after removing the bobbin case and hook.

Figure 6:
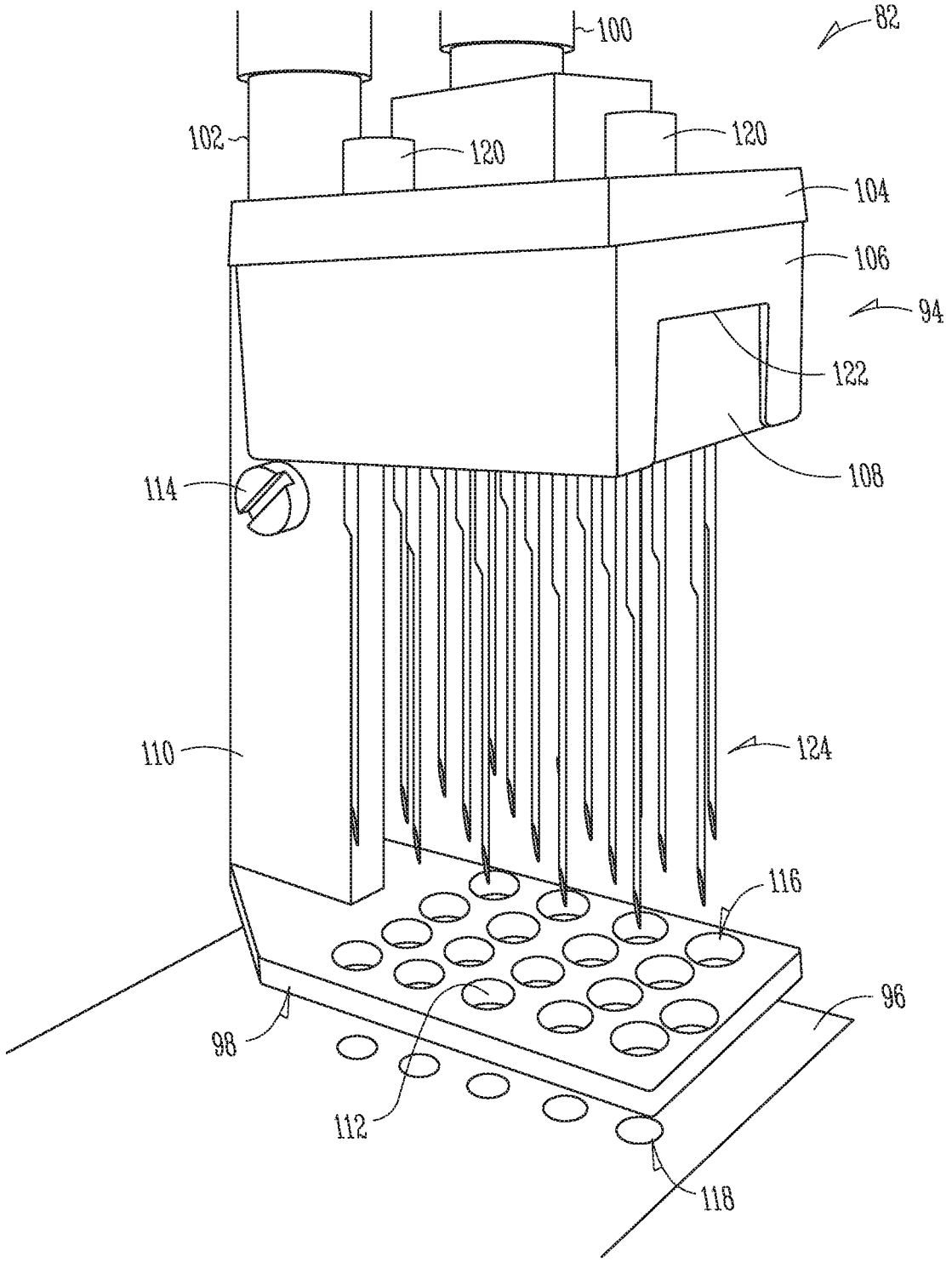
FIG. 6 is close-up view of the multi-needle felting assembly of the stitching machine of FIG. 5A showing a hook cover plate, a presser foot and a stitching jig.
Figure 7:
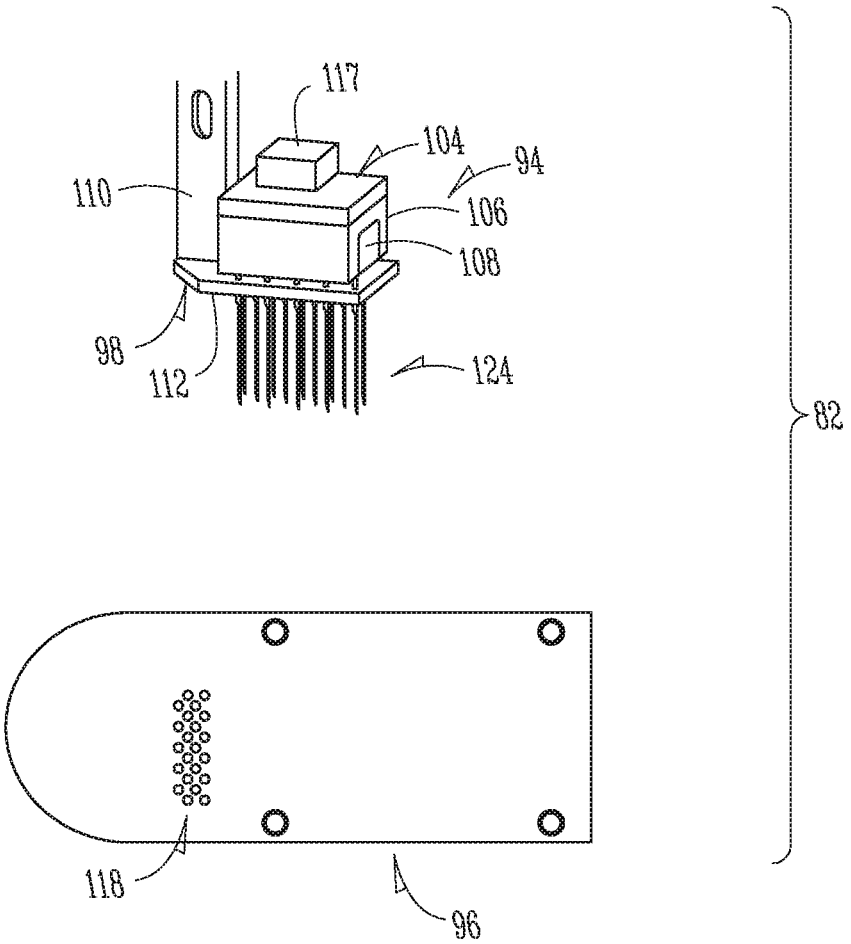
FIG. 7 is a partially exploded view of the multi-needle felting assembly of FIG. 6 showing the hook cover plate, presser foot and stitching jig.

FIG. 6 is close-up view of multi-needle felting assembly 82 of stitching machine 80 of FIG. 5A showing stitching jig 94, hook cover plate 96 and presser foot 98. FIG. 7 is a partially exploded view of multi-needle felting assembly 82 of FIG. 6 showing hook cover plate 96, presser foot 98 and stitching jig 94. FIGS. 6 and 7 are discussed concurrently.

Multi-needle felting assembly 82 can include presser foot 98, as well as stitching jig 94 and hook cover plate 96. Stitching jig 94 can be mounted to punching bar 100 and presser foot 98 can be mounted to presser bar 102. Stitching jig 94 can comprise fixing jig 104, needle clamp hoop 106 and needle holder 108. Presser foot 98 can include lifter 110 and plate 112.

As shown in FIG. 6, lifter 110 of presser foot 98 can be connected to presser bar 102, such as via fastener 114. Lifter 110 can include a bore or socket (e.g., between flanges 158A and 158B of FIG. 8) into which presser bar 102 can be inserted. Fastener 114 can penetrate the socket to engage presser bar 102. Presser bar 102 can be held in a stationary position relative to housing 84 of stitching machine 80 (FIG. 5A). Presser bar 102 can, however, be configured to be raised and lowered relative to cover plate 96, such as via an action of an operator of stitching machine 80. For example, housing 84 can include a lever that raises and lowers presser bar 96 and a locking mechanism that immobilizes presser bar 102. As such, plate 112 of presser foot 98 can be adjusted to a desired height above cover plate 96 to allow material components of different thicknesses to be inserted between presser foot 98 and cover plate 96, with an appropriate or desired amount of pressure to be applied by presser foot 98 onto the material component.

Plate 112 of presser foot 98 can include needle holes 116. Cover plate 96 can include needle holes 118. Needle holes 116 and needle holes 118 can be arranged to have the same number and size of holes and that are arranged in the same pattern. In other examples, plate 112 can have a smaller subset of holes 116 as compared to holes 118, but arranged in the same pattern. Presser bar 102 can hold presser foot 98 so that holes 116 align with holes 118. Holes 116 and 118 can be configured as through-bores through plate 112 and cover plate 96, respectively.

Punching bar 100 is coupled to stitching machine 80 in a moveable manner so as to be able to be reciprocated relative to cover plate 96, as discussed above. Punching bar 100 can comprise a reciprocating bar that can couple to fixing jig 104. As shown in FIG. 7, fixing jig 104 can include socket 117 into which punching bar 100 can be inserted. Fixing jig 104 can include a fastener (not shown) to secure punching bar 100 within socket 117. Fixing jig 104 can connect to needle clamp hoop 106. For example, fasteners 120 can be inserted through fixing jig 104 and into needle clamp hoop 106. Needle clamp hoop 106 can comprise a body that facilitates attachment of a block of needles to fixing jig 104 and punching bar 100. For example, needle clamp hoop 106 can include socket 122 into which needle holder 108 can be disposed. Needle holder 108 can comprise a body having a plurality of sockets for receiving needles 124. The plurality of sockets can be arranged in the same pattern as holes 116 and 118. As such, needles 124 can extend from needle holder 108 of stitching jig 94, through holes 116 in presser foot 98 and into holes 118 in cover plate 96.

Figure 8:
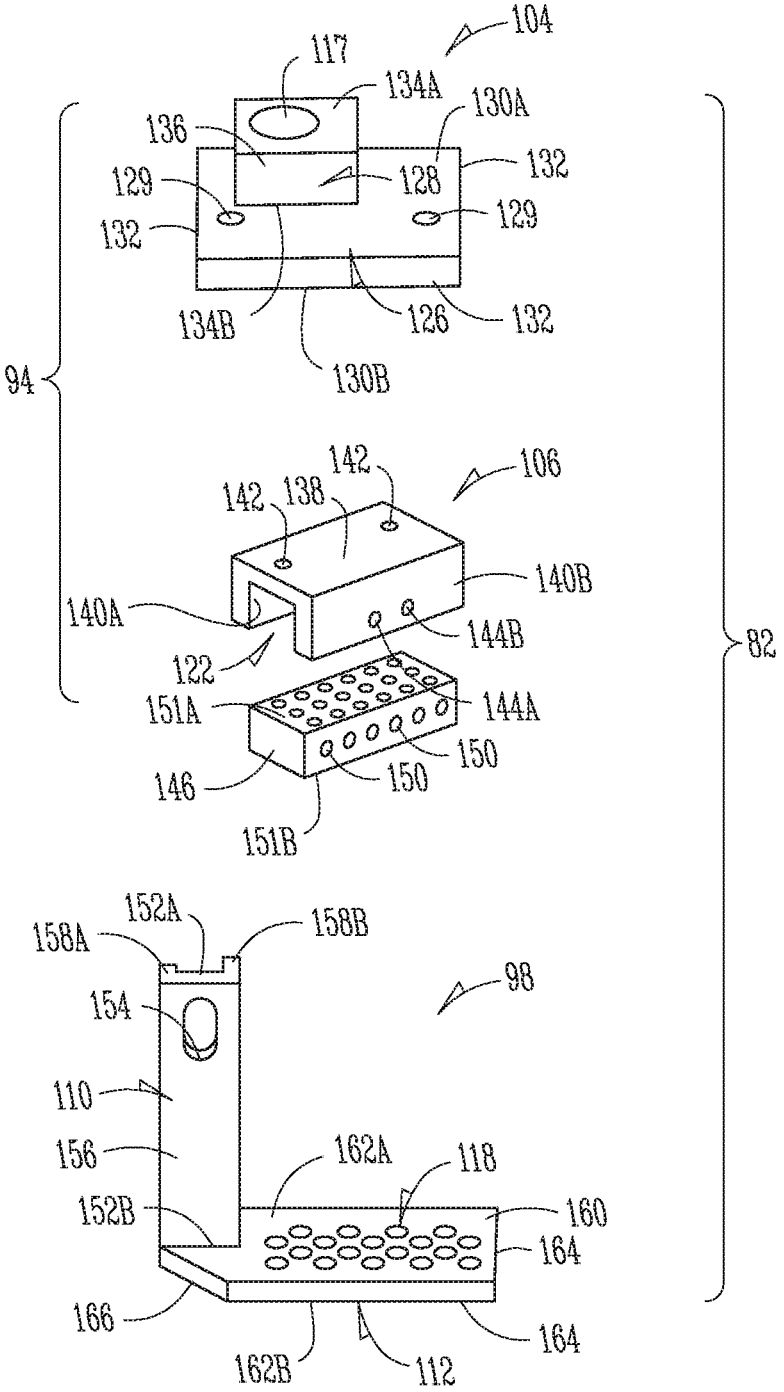
FIG. 8 is an exploded view of the multi-needle felting assembly of FIG. 7 showing the presser foot and the stitching jig including a needle holder, a needle clamp hoop and a fixing jig.

As shown in FIG. 6, needle holes 116 in plate 112 of presser foot 98 can be arranged in a matrix. For example, FIG. 6 shows a four-by-nine matrix having four columns and nine rows. Two columns are illustrated as having four of holes 116 and two columns are illustrated as having five of holes 116. Each row is illustrated as having two of holes 116. The columns can be offset from the rows such that each row does not include a hole 116 in each column. In other words, the columns and rows are offset so that the density of holes 116 can be increased by having holes 116 partially overlap in adjacent rows and columns. Holes 118 in cover plate 96 can be arranged in the same matrix pattern with the same or a larger amount of holes 118. For example, as shown in FIG. 7, holes 118 can be arranged in a four-by-nine matrix wherein each row has two of holes 118 and there are two columns with six of holes 118 and two columns with five of holes 118. Thus, even though a different amount of holes are present, the holes are sized and arranged so that each of holes 116 in presser foot 98 aligns with one of holes 118 in cover plate 96. Because cover plate 96 includes a greater number of holes 118, the position of presser foot 98 and needles 124 can be adjusted relative to cover plate 96 without having to change the position of cover plate 96 to realign holes 118. As shown in FIG. 8, needle holder 108 can have a plurality of sockets (e.g., needle bores 148) arranged in the same matrix pattern as that of holes 116 and holes 118. Holes 116 and 118 can, in various examples have diameters of approximately 3.1 millimeters.

FIG. 8 is an exploded view of multi-needle felting assembly 82 of FIG. 7 showing presser foot 98 and stitching jig 94, including needle holder 108, needle clamp hoop 106 and fixing jig 104. In various embodiments, presser foot 98, needle holder 108, needle clamp hoop 106 and fixing jig 104 can be fabricated from steel materials.

Fixing jig 104 can include base 126 and neck 128. Base 126 can include coupling bores 129 and neck 128 can include socket HT Base 126 can comprise a hexahedron body having first major surface 130A and second major surface 130B that are connected by four side surfaces 132. Neck 128 can comprise a hexahedron body connected to first major surface 130A. Neck 128 can include first major surface 134A and second major surface 134B that are connected by four side surfaces 136. Base 126 and neck 128 can have other shapes than hexahedron, such as cylindrical or oval, and can have smooth or chamfered sides rather than edges. It is desirable that base 126 have a large enough surface area to cover the matrix of holes 118 in presser foot 98 and bores 148 in needle holder 108 in order to ensure adequate force transmission from punching bar 100 to each of needles 124. Neck 128 and base 126 can be fabricated from the same monolithic piece of material, such as via machining. In other examples, neck 128 can be attached to base 126 such as via welding or brazing.

Needle clamp hoop 106 can include back wall 138 and side flanges 140A and 140B. Backing wall 138 can include coupling bores 142 and each side flange 140A and 140B can include coupling bores 144A and 144B. Back wall 138 can comprise a hexahedron body having the same perimeter shape as base 126 of fixing jig 104. Coupling bores 142 are configured to align with coupling bores 129. Fasteners, such as fasteners 120 (FIG. 6) can be inserted through coupling bores 129 and into coupling bores 142 to connect fixing jig 104 to needle clamp hoop 106. Side flanges 140A and 140B can extend from edges of back wall 138 so that side flange 140A, back wall 138 and side flange 140B for a U-shaped body forming socket 122. Socket 122 can comprise a hexahedron shape that can match the shape of needle holder 108. Flanges 140A and 140B can comprise hexahedron shaped bodies that extend from back wall 138. Flanges 140A and 140B can be fabricated from the same monolithic piece of material as back wall 138, such as via machining. In other examples, flanges 140A and 140B can be attached to back wall 138 such as via welding or brazing. Needle clamp hoop 106 is illustrated and described as having a particular rectangular shape. However, needle clamp hoop 106 can have other shapes that permit coupling to fixing jig 104 and reception of needle holder 108. It is desirable that needle clamp hoop 106 be firmly engaged with fixing jig 104 and needle holder 108 to prevent vibration, misalignment or improper transmission of forces from punching bar 100 (FIG. 6) to needles 124 (FIG. 6).

Needle holder 108 can include block 146 and needle bores 148. Block 146 can comprise a hexahedron shaped body that fits within socket 122. Needle holder 108 can include coupling bores 150. Fasteners can be inserted through coupling bores 144A and 144B in needle clamp hoop 106 to engage coupling bores 150 of needle holder 108. Needle holder 108 can have a plurality of coupling bores 150 so that the position of block 146 can be adjusted in socket 122. Needle bores 148 are configured to receive the non-pointed or non-barbed ends of needles 124. Needle bores 148 can comprise through-bores that extend all the way through needle holder 108 from a first major surface 151A to a second major surface 151B. Each of needle bores 148 can be sized to receive one of needles 124 in a force-fit manner. Engagement of needle holder 108 with back wall 138 can help prevent needles 124 from being pushed out of needle bores 148 during operation of stitching jig 94. Needle holder 108 is described as having a rectangular shape, but can have other shapes that facilitate reception of needles 124 and assembly with needle clamp hoop 106. Assembly of needle holder 108 with needle clamp hoop 106 and fixing jig 104 can be configured to align needle bores 108 with needle holes 118 of presser foot 98.

Presser foot 98 can include lifter 110 and plate 112. Lifter 110 can comprise an elongate body having first end 152A and second end 152B and slot 154. Lifter 110 can have a variety of different cross-sectional profiles between first end 152A and second end 152B. For example, in the depicted embodiment, lifter 110 has a C-shaped cross-sectional profile wherein main body 156 includes flanges 158A and 158B that can provide strengthening to main body 156, for example. Lifter 110 can be configured to be coupled to presser bar 102 (FIG. 6). For example, presser bar 102 can include a bore (not shown) that can be threadably coupled to fastener 114 (FIG. 6). Fastener 114 can be extended through slot 154 in main body 156 before coupling to the bore of presser bar 102 to connect presser foot 98 to presser bar 102. Slot 154 can be oblong in shape, or wider that the width of fastener 114, so that main body 156 can be adjustably positioned relative to presser bar 102.

Plate 112 of presser foot 98 can comprise body 160 having first major surface 162A and second major surface 162B that can be connected by side surfaces 164. Side surfaces 164 can be hexahedron and can include one or more chamfers 166 to remove sharp edges and prevent snagging with material components being slid underneath plate 112. Lifter 110 can be attached to an edge of plate 112 so that holes 118 can be positioned over holes 116 of cover plate 96 without interference from lifter 110 and presser bar 102. Plate 112 and lifter 110 can be fabricated from the same monolithic piece of material, such as via machining. In other examples, plate 112 and lifter 110 can be attached to each other such as via welding or brazing. Lifter 110 and plate 112 are described as illustrated and described as having particular shapes, but can be fabricated in other shapes that provide enough surface area for holes 118 and that can provide coupling to presser bar 102, for example.

Figure 9A:
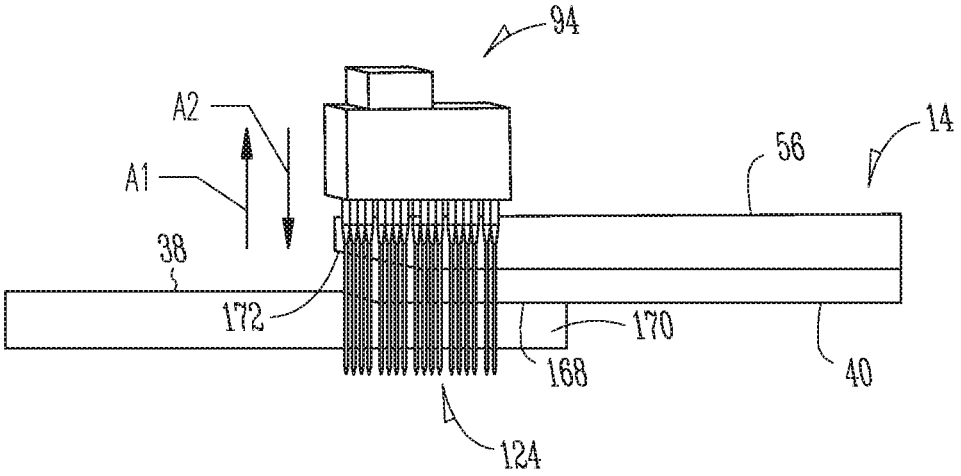
FIG. 9A is a schematic view of the stitching jig of FIGS. 6-8 having barbed needles pushed through layers of a shoe upper including a felt backing layer.

FIG. 9A is a schematic view of stitching jig 94 of FIGS. 6-8 having barbed needles 124 pushed through layers 38 and 40 of shoe upper 14. Shoe upper 14 can include toe panel 38, heel panel 40 and backing panel 56. As discussed above with reference to FIG. 4, toe panel 38 and heel panel 40 can be positioned to partially overlap at lap joint 168. Backing panel 56 can be positioned to cover lap joint 168. Toe panel 38 can be partially skived at lap joint 168 to form thinned portion 170. Backing panel 56 can also be skived or thinned at or adjacent lap joint 168, such as via inclusion of chamfer 172. Chamfer 172 and thinned portion 170 can assist in eliminating or reducing bulges in shoe upper 14. Stitching jig 94 can be reciprocated (as shown by arrows A1 and A2) through backing panel 56, heel panel 40 and toe panel 38 to produce felting 12A (FIG. 4). In particular, needles 124 can include hooks or barbs that grab or snag fibers 58 of backing panel 56 to push fibers 58 through toe panel 38 and heel panel 40.

Figure 9C:
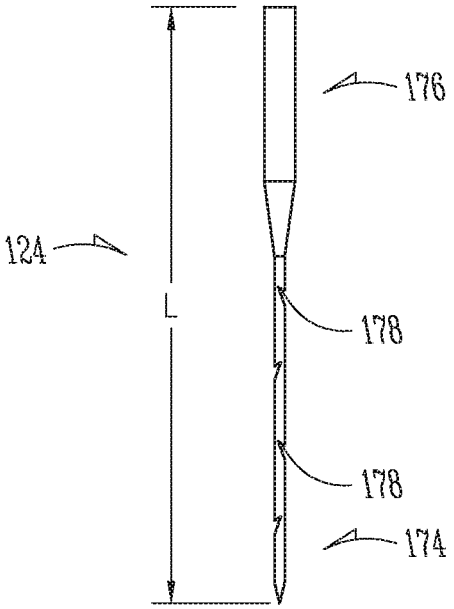
FIG. 9C is a schematic side view of a barbed needle for use in the stitching jig of FIGS. 9A and 9B.
Figure 9B:
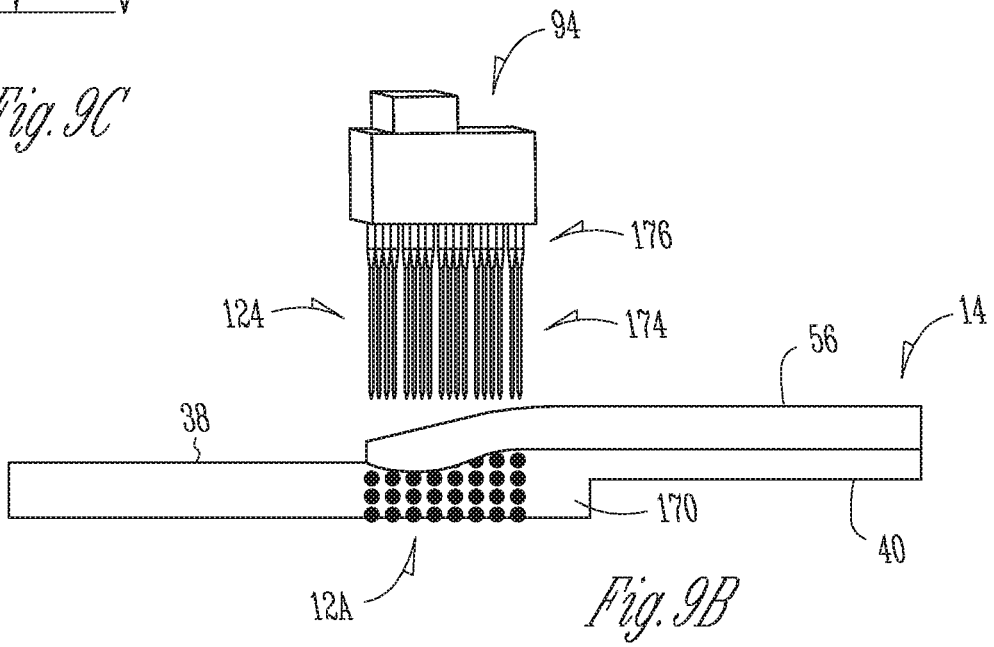
FIG. 9B is a schematic view of the stitching jig of FIG. 9A with the barbed needles withdrawn from the layers of the shoe upper to show felting fibers entrained in the shoe upper layers.

FIG. 9B is a schematic view of stitching jig 94 of FIG. 9A with barbed needles 124 withdrawn from layers 38 and 40 of shoe upper 14 to show felting fibers 58 entrained in shoe upper 14 layers. Barbed needles 124 can include small barbs or hooks 178 (FIG. 9C) at distal portions 174 that become entrained with the fibers or strands of backing panel 56 to grab fibers 58. Hooks 178 can be shaped and oriented so that when needles 124 move downward through backing panel 56 the fibers or strands of backing panel 56 attach to hooks 178, thereby also dragging fibers 58 through toe panel 38 and heel panel 40. However, hooks 178 can be shaped and oriented so that as needles 124 move upward through toe panel 38 and heel panel 40, hooks 178 release fibers 58 so that fibers 58 remain extended through toe panel 38 and heel panel 40 and hooks 178 do not pull fibers 58 back up as stitching jig 94 move back up. Stitching jig 94 can be reciprocated to repeatedly move needles through backing panel 56 and push fibers 58 through toe panel 38 and heel panel 40 to produce felting 12A. The longer stitching jig 94 is held in one place, the more of fibers 58 will be pushed through toe panel 38 and heel panel 40. Thus, the density of felting produced by stitching jig 94 can be varied by the number of needles 124 and length of time the stitching process is carried out.

FIG. 9C is a schematic side view of barbed needle 124 for use in the stitching jig of FIGS. 9A and 9B. Needle 124 can extend from distal portion 174 to proximal portion 176, and can include hooks 178. In an example, needles 124 can be commercially available needles, such as those available from Groz-Beckert Industrial CO., LTD. In other examples, commercially available needles can be cut down to shorter lengths for coupling with bores 148 of needle holder 106. For example, proximal portions 176 of needles 124 can be shortened so that the total length L of each needle 124 is approximately 37.0 millimeters. As shown in FIG. 9C, hooks 178 are oriented downward toward distal portion 174 so that needle 124 can push fibers through a material. In other embodiments, hooks 178 can be oriented upward toward proximal portion 176 so as to be configured to pull fibers through a material. The felting process described with reference to FIGS. 9A-9C can be used to manufacture shoe uppers having panels attached to each other via the felting process, as discussed with reference to FIGS. 10-11H.

Figure 10:
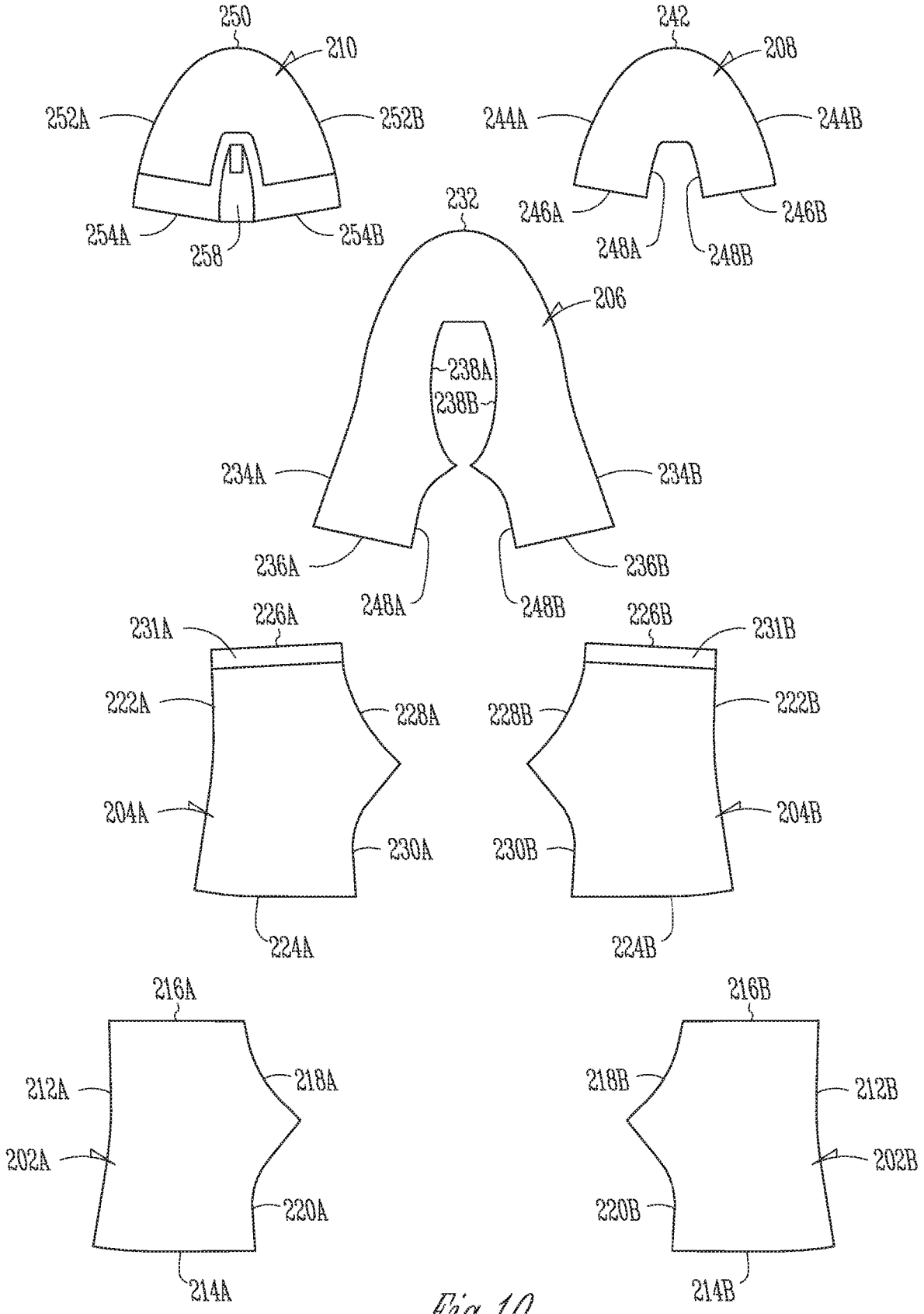
FIG. 10 is a plan view of various layers of a shoe upper, such as for the article of footwear of FIGS. 1 and 2, including medial and lateral quarters, medial and lateral felt backing layers, a needle punch reinforcement layer, a vamp reinforcement layer and a vamp.

FIG. 10 is a plan view of various material component layers, or sheets, of shoe upper 200, such as for article of footwear 10 of FIGS. 1 and 2, including medial and lateral quarters 202A and 202B, medial and lateral backing layers 204A and 204B, needle punch reinforcement layer 206, vamp reinforcement layer 208 and vamp 210.

Quarters 202 and 202B can comprise portions of shoe upper 200 that form an outer layer of a heel portion of a shoe. Medial quarter 202A can comprise sole edge 212A, heel edge 214A, intermediate edge 216A, throat edge 218A and collar edge 220A. Lateral quarter 202B can comprise sole edge 212B, heel edge 214B, intermediate edge 216B, collar edge 220B and throat edge 222B. In an example, quarters 202A and 202B can be made of a lightweight, cloth material, such as a nylon mesh. In an example, quarters 202A and 202B can be approximately 1.0 millimeter thick.

Medial and lateral backing layers 204A and 204B can comprise portions of shoe upper 200 that form an inner layer of a heel portion of a shoe. Medial layer 204A can comprise sole edge 222A, heel edge 224A, intermediate edge 226A, throat edge 228A and collar edge 230A. Lateral layer 204B can comprise sole edge 222B, heel edge 224B, intermediate edge 226B, throat edge 228B and collar edge 230B. In an example, medial and lateral layers 204A and 204B can be made of a felt material and can be used as the basis of a felting layer. In an example, backing layers 204A and 204B can be approximately 1.5 millimeters thick.

Medial and lateral backing layers 204A and 204B can also comprise skiving areas 231A and 231B, respectively. In examples, skiving areas 231A and 231B can have widths of approximately 6.0 millimeters in order to permit sufficient overlap with skiving area 256 of vamp 210. Skiving areas 231A and 231B can have a thickness or depth to accommodate the thickness of medial and lateral quarters 202A and 202B when assembled. In examples, skiving areas 231A and 231B can have thicknesses of approximately 0.8 millimeters.

Needle punch reinforcement layer 206 can comprise a portion of shoe upper 200 that forms an inner layer of toe and lateral portions of a shoe. Needle punch reinforcement layer 206 can comprise toe edge 232, sole edges 234A and 234B, heel edges 236A and 236B, throat edges 238A and 238B and collar edges 240A and 240B. In an example, needle punch reinforcement layer 206 can comprise a cloth material.

Vamp reinforcement layer 208 can comprise portions of shoe upper 200 that form an inner layer of a toe portion of a shoe. Vamp reinforcement layer 208 can comprise toe edge 242, sole edges 244A and 244B, intermediate edges 246A and 246B and throat edges 248A and 248B. In an example, vamp reinforcement layer 208 can comprise canvas material.

Vamp 210 can comprise a portion of shoe upper 200 that forms an outer layer of a toe portion of a shoe. Vamp 210 can comprise toe edge 250, sole edges 252A and 252B and intermediate edges 254A and 254B. Vamp 210 can also comprise skiving area 256 that can form throat area 258. Skiving area 256 can be sufficiently large to accommodate the needle punching process described therein and also to permit folding of the shoe upper, such as around the throat area of the shoe. In an example, vamp 210 can comprise leather material. In an example, vamp 201 can be approximately 1.2 to 1.4 millimeters thick.

As described below with reference to FIGS. 11A-11H, medial and lateral quarters 202A and 202B, medial and lateral backing layers 204A and 204B, needle punch reinforcement layer 206, vamp reinforcement layer 208 and vamp 210 can be layered up and attached to fashion an upper for an article of footwear using, at least partially, multi-needle felting assembly 82 described above with reference to FIGS. 5-9C.

Figure 11A:
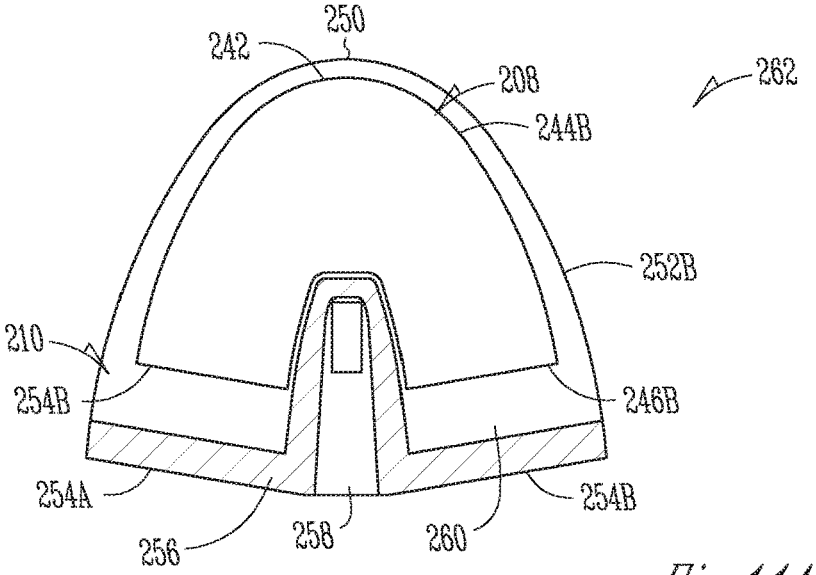
FIG. 11A is a plan view of the vamp reinforcement layer attached to an interior side of the vamp of FIG. 10.

FIG. 11A is a plan view of vamp reinforcement layer 208 attached to an interior side of vamp 210 of FIG. 10. Vamp 210 is positioned so that inside surface 260 is showing and skiving 256 is facing up. Vamp reinforcement layer 208 is uniform such that it is the same face up or face down. Vamp reinforcement layer 208 has a similar profile shape as vamp 210, but is smaller so that vamp reinforcement layer 208 can be bounded by vamp 210 when vamp reinforcement layer 208 is positioned, e.g., centered, on top of vamp 210. Vamp reinforcement layer 208 is positioned adjacent vamp 210 so that toe edges 242 and 252 are spaced from each other and intermediate edges 246A and 246B are spaced from intermediate edges 254A and 254B, respectively. Correspondingly, sole edges 244A and 244B will be spaced from sole edges 252A and 252B, respectively. Vamp reinforcement layer 208 can be attached to vamp 210 to form a layered stack of material components comprising reinforced vamp 262. Vamp reinforcement layer 208 can be attached to vamp 210 using a variety of suitable methods. In embodiments, vamp reinforcement layer 208 is attached using hot melt adhesive. For example, HM-102P can be applied at a temperature of approximately 150°-175° C.

Figure 11B:
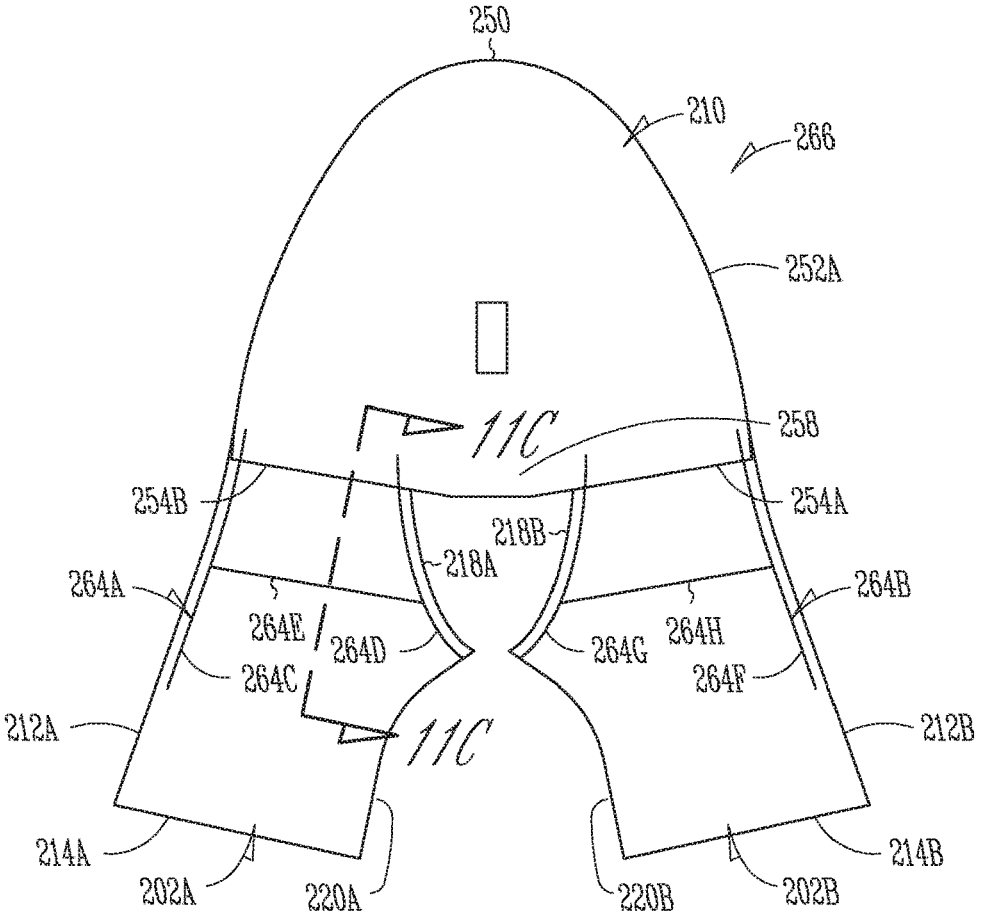
FIG. 11B is a plan view of the outside of the vamp, medial and lateral quarters, and medial and lateral felt layers of FIG. 10 attached to each other via anchor stitching.

FIG. 11B is a plan view of the outside of vamp 210, medial and lateral quarters 202A and 202B, and medial and lateral backing layers 204A and 204B (not visible) of FIG. 10 attached to each other via anchor stitching 264A and 264B. The material components of FIG. 11B form a layered stack comprising rough shoe upper 266.

Medial quarter 202A can have the same shape and size as medial backing layer 204A, except medial backing layer 204A can have the addition of skiving area 231A. Medial quarter 202A can be positioned over the top of medial backing layer 204A so that skiving area 231A protrudes from behind medial quarter 202A. Lateral quarter 202B can have the same shape and size as lateral backing layer 204B, except lateral backing layer 204B can have the addition of skiving area 231B. Lateral quarter 202B can be positioned over the top of medial backing layer 204B so that skiving area 231B protrudes from behind lateral quarter 202B. Reinforced vamp 262 can be positioned with an exterior surface 267 facing outward (with skiving area 256 facing in) so that intermediate edges 264A and 264B cover skiving areas 231B and 231A, respectively, which are facing out.

Anchor stitching 264A and 264B can be provided to initially attach quarters 202A and 202B to vamp 210, and backing layers 204A and 204B to quarters 202A and 202B, respectively. Anchor stitching 264A can be placed in three legs 264C, 264D and 264E. Anchor stitching 264B can be placed in three legs 264F, 264G and 264H. Anchor stitching 264A and 264B can be applied with a computer controlled stitching machine. Anchor stitching 264A and 264B can be constructed similarly to stitch 54 (FIG. 3).

Anchor stitching leg 264C can be positioned to extend along edge 252A of vamp 210 and edge 212B of lateral quarter 202B. Anchor stitching leg 264D can positioned along edge 218B of lateral quarter 202B and can extend into vamp 210. Anchor stitching leg 264E can be positioned to connect anchor stitching legs 264C and 264D, and can be positioned anywhere between anchor stitching legs 264C and 264D. Anchor stitching legs 264C and 264D can be positioned approximately 2.0 millimeters from the edges of vamp 210 and lateral quarter 202B. Anchor stitching 264A can have a stitch density of 9 to 10 stitches per inch (~3.5 to 3.9 stitches per centimeter). Anchor stitching legs 264F, 264G and 264H can be positioned and configured similarly to anchor stitching legs 264C, 264D and 264E, respectively.

Figure 11C:
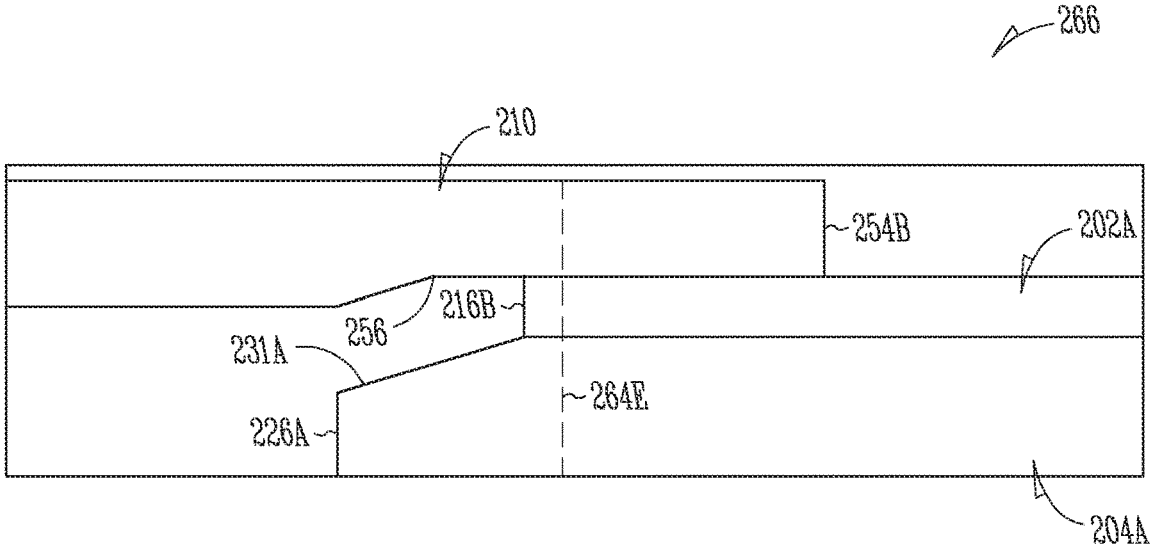
FIG. 11C is a schematic cross-sectional view of the vamp, medial quarter, and medial felt backing layer of FIG. 11B showing skiving of the vamp and felt backing layer and the anchor stitching.

As mentioned, vamp 210 can be positioned so that intermediate edges 254A and 254B extend over skiving areas 231A and 231B, as can be best seen in FIG. 11C.

FIG. 11C is a schematic cross-sectional view of vamp 210, medial quarter 202A, and medial hacking layer 204A of FIG. 11B showing skiving area 256 of vamp 210, skiving area 231A of backing layer 204A and anchor stitching 264E. The outer surface of medial quarter 202A is positioned adjacent skiving area 256 of vamp 210 so that lateral edge 216B is within skiving area 256. Medial backing layer 204A is positioned adjacent the inner surface of medial quarter 202A so that skiving area 231A faces outward opposite skiving area 256. Thus, skiving area. 231A can align with skiving area 256 to limit the thickness of rough shoe upper 266. Anchor stitching 264E can be applied through all three layers of vamp 210, medial quarter 202A and medial backing layer 204A. Anchor stitching 264E can immobilize vamp 210, medial quarter 202A and medial backing layer 204A for the formation of rough shoe upper 266 and in preparation for a felting process.

Figure 11D:
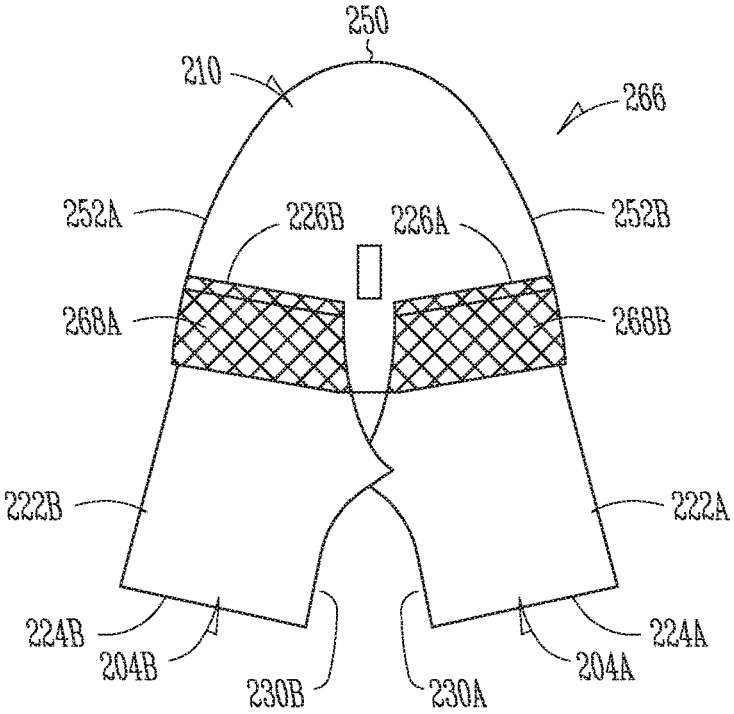
FIG. 11D is a plan view of the inside of the vamp and the medial and lateral felt layers after a felting process.

FIG. 11D is a plan view of the inside of vamp 210 and medial and lateral backing layers 204A and 204B of rough shoe upper 266 after a felting process. Vamp reinforcement layer 208 is not shown in FIG. 11D. Medial and lateral quarters 202A and 202B are disposed underneath medial and lateral backing layers 204A and 204B, respectively, and are therefore not visible in FIG. 11D. A felting process can be applied to the interior surface of medial and lateral backing layers 204A and 204B shown in FIG. 11D to form felting areas 268A and 268B. Felting areas 268A and 268B are applied across skiving area 231A of vamp 210 and skiving area 256 of backing layer 204A (FIG. 11C). In an example, stitching machine 80 described above can be operated at approximately 400 to 600 revolutions per minute (RPM) to reciprocate stitching jig 94, with presser foot 98 positioned approximately 2.5 millimeters to 3.0 millimeters above cover plate 96. Felt of backing layers 204A and 204B can be cleaned using compressed air. After the felting process rough shoe upper 266 can be passed through a metal detector machine to ensure that any metal particles are not present in rough shoe upper 266 that may have resulted from the felting process.

Figure 11E:
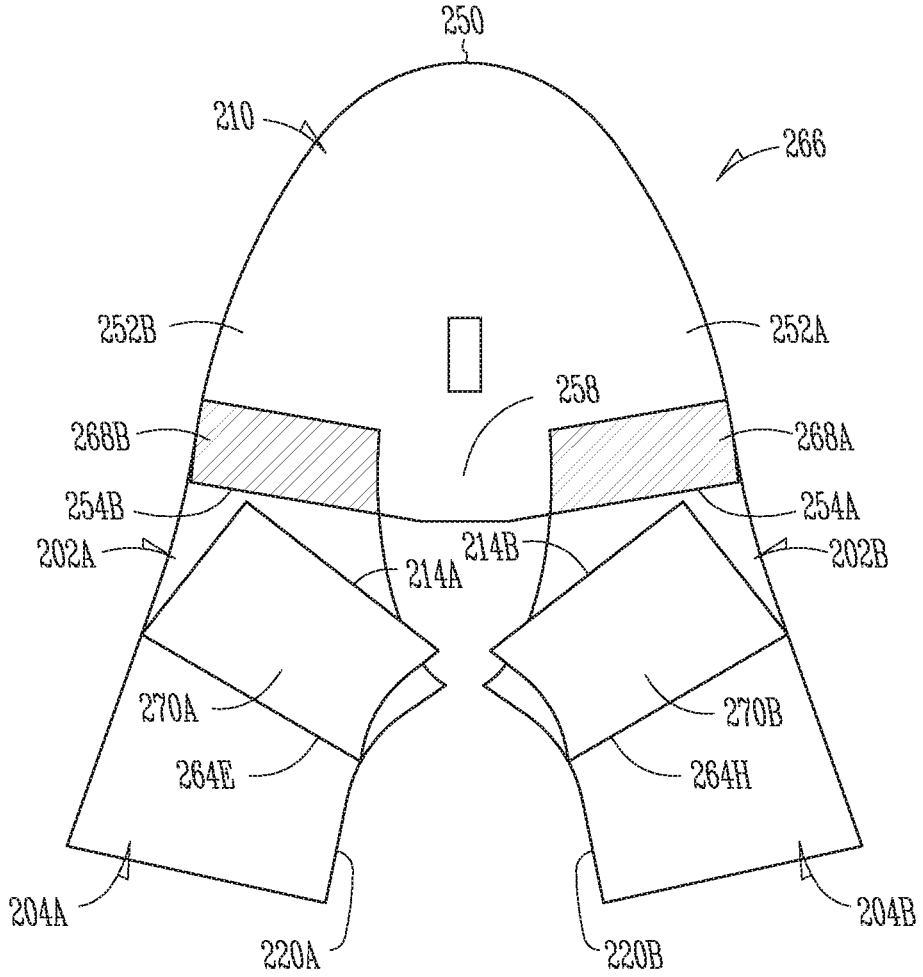
FIG. 11F is a plan view of the outside of the shoe upper layers of FIG. 11D showing the location for adhesive between the medial and lateral quarters and the medial and lateral felt layers.
FIG. 11G is a plan view of the inside of the shoe upper layers of FIG. 11F after the needle punch reinforcement layer is attached.
FIG. 11H is a schematic cross-sectional view of the shoe upper layers of FIG. 11G showing the build-up of the various components of FIGS. 11A-11G.

FIG. 11E is a plan view of the outside of rough shoe upper 266 of FIG. 11D showing the location for adhesive areas 270A and 270B between medial and lateral quarters 202A and 202B and medial and lateral backing layers 204A and 204B, respectively. Medial and lateral quarters 202A and 202B can be peeled back up to anchor stitching 264A and 264B, respectively, so that an adhesive can be applied between medial and lateral quarters 202A and 202B and medial and lateral backing layers 204A and 204B, respectively, at adhesive areas 270A and 270B. In embodiments, medial and lateral backing layers 204A and 204B are attached using a hot melt adhesive spray process. For example, HM-102P can be applied at a temperature of approximately 150°-175° C. Hot melt adhesive can be applied to medial and lateral backing layers 204A and 204B in heel and quarter areas where needle punching or felting is not present.

Figure 11F:
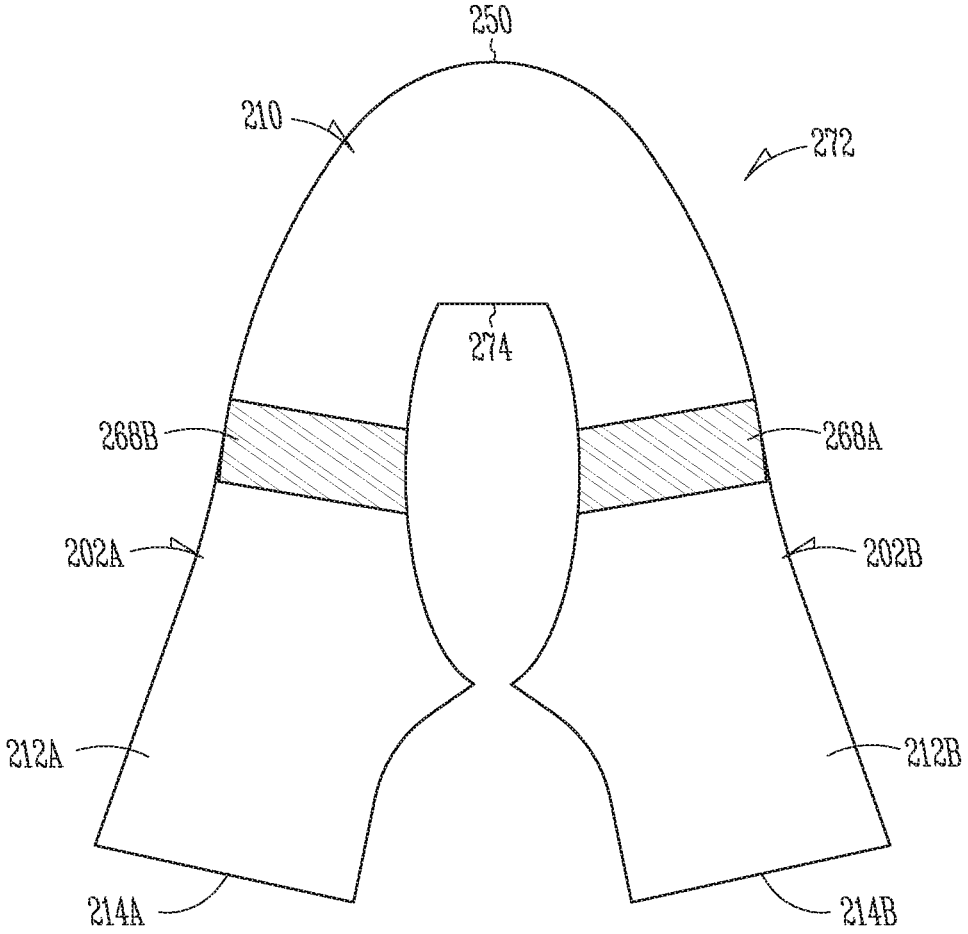

FIG. 11F is a plan view of the outside of rough shoe upper 266 of FIG. 11E after cutting to form refined shoe upper 272. Refined shoe upper 272 can include vamp 210, medial quarter 202A and lateral quarter 202B, with medial and lateral backing layers 204A and 204B and vamp reinforcement layer 208 being attached to the underside. Vamp 210 can be cut to remove throat area 258 and form throat cut 274. Cutting of rough shoe upper 266 can be performed with a swing arm cutting machine.

Figure 11G:
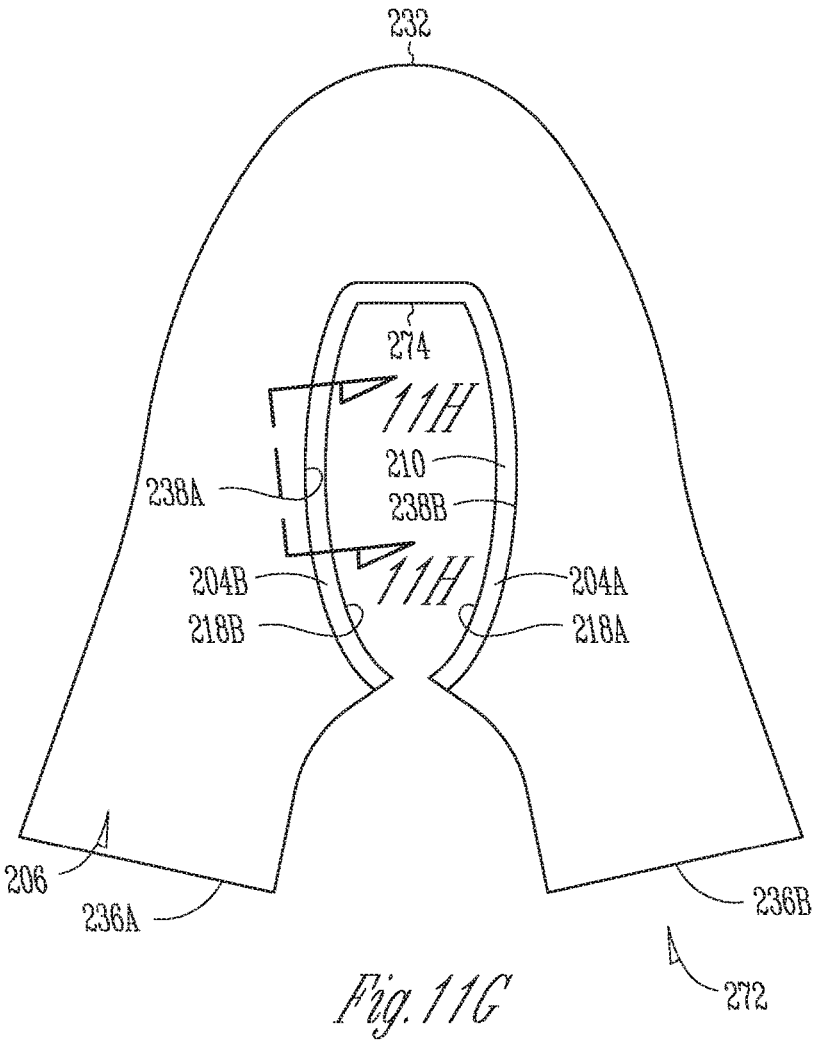

FIG. 11G is a plan view of the inside of refined shoe upper 272 of FIG. 11F after needle punch reinforcement layer 206 is attached. Needle punch reinforcement layer 206 can be shaped to match the size and shape of refined shoe upper 272 after rough shoe upper 266 has been cut down to size. Needle punch reinforcement layer 206, however, can be slightly smaller in collar area so that throat cut 274 of vamp 210 and throat edges 218A and 218B of medial and lateral backing layers 204A and 204B, respectively, are exposed. Needle punch reinforcement layer 206 can provide a single-piece reinforcement to the various components of refined shoe upper 272, such as felting areas 268A and 268B. In an example, reinforcement layer 206 can comprise lining layer 46 (FIG. 2). Needle punch reinforcement layer 206 can be attached to rough shoe upper 266 with an adhesive, such as a hot melt adhesive. For example, HM-102P can be applied at a temperature of approximately 150° to 175° C. Additional finishing processes, such as pressing refined shoe upper 272 at a temperature of approximately 130° to 150° C. at a pressure of 5 to 6 kg/cm$^2$ for approximately 4 to 6 minutes, can be performed on refined shoe upper 272. Subsequently, any edge folding, binding or stitching and turning operations that are desired can be performed, such as along throat and collar portions of refined shoe upper 272.

Figure 11H:
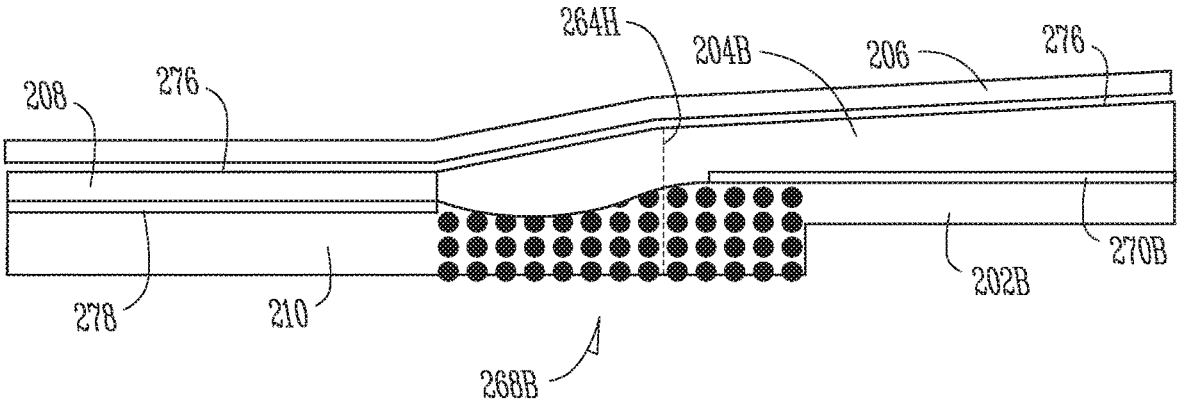

FIG. 11H is a schematic cross-sectional view of refined shoe upper 272 of FIG. 11G showing the build-up of the various material components of FIGS. 11A-11G. Refined shoe upper 272 can comprise needle reinforcement layer 206, lateral backing layer 204B lateral quarter 202B, vamp reinforcement layer 208 and vamp 210. FIG. 11H shows adhesive layer 276 disposed between reinforcement layer 206 and vamp reinforcement layer 208 and lateral backing layer 204B. Adhesive area 270B is also shown between lateral backing layer 204B and later quarter 202B. Adhesive layer 278 is shown between vamp 210 and vamp reinforcement layer 208.

Adhesive layer 276 can be formed using the steps described with reference to FIG. 11G. Adhesive area 270B can be formed using the steps described with reference to FIG. 11E. Adhesive layer 278 can be formed using the steps described with reference to FIG. 11A. Felting 268B can be formed using the steps described with reference to FIGS. 9A and 9B. Anchor stitching 264H can be formed using the steps described with reference to FIG. 11B.

Various Notes & Examples

Example 1 can include or use subject matter such as a needle assembly for a stitching machine that can comprise: a stitching jig comprising: a needle holder having a plurality of needle sockets configured to hold a plurality of needles; a needle clamp hoop connected to the needle holder to retain needles in the plurality of needle sockets; and a fixing jig connected to the needle clamp hoop configured to couple with a reciprocating bar of the stitching machine.

Example 2 can include, or can optionally be combined with the subject matter of Example 1, to optionally include a presser foot that can comprise: a lifter configured to couple with a presser bar of the stitching machine; and a presser foot plate having a plurality of through-bores configured to align with the plurality of sockets.

Example 3 can include, or can optionally be combined with the subject matter of one or any combination of Examples 1 or 2 to optionally include a hook cover plate that can include a plurality of holes configured to align with the plurality of needle sockets.

Example 4 can include, or can optionally be combined with the subject matter of one or any combination of Examples 1-3 to optionally include a fixing jig that can include a bar socket configured to receive the reciprocating bar, the bar socket disposed parallel to each of the plurality of needle sockets.

Example 5 can include, or can optionally be combined with the subject matter of one or any combination of Examples 1-4 to optionally include a needle holder that can comprise: an upper surface; a lower surface disposed opposite the upper surface; a first side wall extending between the upper surface and the lower surface; and a second side wall extending between the upper surface and the lower surface opposite the first side wall; wherein the plurality of needle sockets are arranged in a matrix where each of the plurality of sockets extends from the upper surface to the lower surface.

Example 6 can include, or can optionally be combined with the subject matter of one or any combination of Examples 1-5 to optionally include a needle clamp hoop that can comprise: a backing wall configured to abut the upper surface of the needle holder to dose off each of the plurality of needle sockets in the needle holder; and first and second side flanges extending from the backing wall and configured to engage the first and second side walls of the needle holder.

Example 7 can include, or can optionally be combined with the subject matter of one or any combination of Examples 1-6 to optionally include a plurality of felting needles disposed in the plurality of needle sockets, each felting needle including at least one barb.

Example 8 can include or use subject matter such as a needle punching machine that can comprise: a punching bar connected to the needle punching machine and configured to be reciprocated; a presser bar connected to the needle punching machine and configured to be locked into a stationary disposition; a stitching jig comprising: a fixing jig coupled to the punching bar; and a needle holder having a plurality of sockets; a presser foot comprising: a lifter coupled to the presser bar; and a plurality of through-bores configured to align with the plurality of sockets; and a hook cover plate connected to the needle punching machine opposite the presser foot, the hook cover plate including a plurality of holes configured to align with the plurality of sockets and the plurality of through-bores.

Example 9 can include, or can optionally be combined with the subject matter of Example 8, to optionally include a plurality of felting needles connected to the plurality of sockets in a matrix of multiple rows and columns.

Example 10 can include, or can optionally be combined with the subject matter of one or any combination of Examples 8 or 9 to optionally include a needle holder that can comprise: an upper surface; a lower surface disposed opposite the upper surface; a first side wall extending between the upper surface and the lower surface; and a second side wall extending between the upper surface and the lower surface opposite the first side wall; wherein each of the plurality of sockets extends from the upper surface to the lower surface.

Example 11 can include, or can optionally be combined with the subject matter of one or any combination of Examples 8-10 to optionally include a needle clamp hoop that can comprise: a backing wall configured to abut the upper surface of the needle holder to close off each of the plurality of sockets in the needle holder; and first and second side flanges extending from the backing wall and configured to engage the first and second side walls of the needle holder.

Example 12 can include, or can optionally be combined with the subject matter of one or any combination of Examples 8-11 to optionally include an electric motor configured to reciprocate the punching bar.

Example 13 can include, or can optionally be combined with the subject matter of one or any combination of Examples 8-12 to optionally include a feeding frame configured to retain at least one sheet of material between the presser foot and the hook cover plate and to translate perpendicular to the punching bar.

Example 14 can include or use subject matter such as an a method of manufacturing a shoe upper that can comprise: positioning a first sheet of material for a shoe upper adjacent a hook cover plate including a first matrix of holes; positioning a second sheet of material for the shoe upper to at least partially overlap with the first sheet of material at an overlap adjacent the plurality of holes; reciprocating a stitching jig to repetitively advance a plurality of barbed needles arranged in a second matrix matching the first matrix through the overlap of first and second sheets of material and into the plurality of holes; and translating the first and second sheets of material to move the overlap along the first matrix of holes.

Example 15 can include, or can optionally be combined with the subject matter of Example 14, to optionally include positioning a third sheet of material of the shoe upper between the first and second sheets of material; wherein the first and second sheets of material form exterior surfaces of the shoe upper and the third sheet of material comprises felt.

Example 16 can include, or can optionally be combined with the subject matter of one or any combination of Examples 14 or 15 to optionally include mounting the first and second sheets of material in a feeding frame; moving the feeding frame to translate the first and second sheets of material along a feed path; and reciprocating the feeding frame transverse to the feed path as the feeding frame moves along the feed path.

Example 17 can include, or can optionally be combined with the subject matter of one or any combination of Examples 14-16 to optionally include a stitching jig that can comprise: a needle holder having a plurality of sockets configured to hold the plurality of barbed needles in the second matrix; a needle clamp hoop connected to the needle holder to retain the plurality of barbed needles in the needle holder; and a fixing jig connected to the needle clamp hoop configured to couple with a reciprocating bar of a needle punch machine.

Example 18 can include or use subject matter such as a method for manufacturing an upper for an article of footwear, the method comprising: laying out a first sheet of material; positioning a second sheet of material to at least partially overlap with the first sheet of material at an overlap; positioning a felt material adjacent the overlap so that the second sheet of material is at least partially between the first sheet of material and the felt material; and felting the felt material to draw fibers of the felt material through the first and second sheets of material to join the first and second sheets of material at a felting seam.

Example 19 can include, or can optionally be combined with the subject matter of Example 18, to optionally include skiving the first sheet of material and the felt material at the overlap.

Example 20 can include, or can optionally be combined with the subject matter of one or any combination of Examples 18 or 19 to optionally include applying an anchor stitch along the overlap.

Example 21 can include, or can optionally be combined with the subject matter of one or any combination of Examples 18-20 to optionally include attaching a reinforcement material to portions of the first and second sheets of material to cover the felting seam.

Example 22 can include, or can optionally be combined with the subject matter of one or any combination of Examples 18-21 to optionally include a reinforcement material that can be attached via adhesive.

Example 23 can include, or can optionally be combined with the subject matter of one or any combination of Examples 18-22 to optionally include joining the second sheet of material and the felt material away from the felting seam with an adhesive.

Example 24 can include, or can optionally be combined with the subject matter of one or any combination of Examples 18-23 to optionally include cutting the first and second sheets of material and the felt material to form a shoe upper shape.

Each of these non-limiting examples can stand on its own, or can be combined in various permutations or combinations with one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A method of manufacturing a shoe upper, the method comprising:

cutting a first sheet of material and a second sheet of material to form portions of a shoe upper; positioning the first sheet of material for the shoe upper adjacent a hook cover plate including a first matrix of holes;

positioning the second sheet of material for the shoe upper to at least partially overlap with the first sheet of material at an overlap adjacent the first matrix of holes;

mounting the first sheet of material and the second sheet of material into a feeding frame;

reciprocating a stitching jig to repetitively advance a plurality of barbed needles arranged in a second matrix matching the first matrix through the overlap of first and second sheets of material and into the first matrix of holes;

translating the first and second sheets of material to move the overlap along the first matrix of holes by moving the feeding frame to translate the first and second sheets of material along a feed path; and reciprocating the feeding frame transverse to the feed path as the feeding frame moves along the feed path.

2. The method of claim 1, further comprising:

positioning a third sheet of material of the shoe upper behind the first and second sheets of material;

wherein the first and second sheets of material form exterior surfaces of the shoe upper and the third sheet of material comprises felt.

3. The method of claim 1, wherein the stitching jig comprises:

a needle holder having a plurality of sockets configured to hold the plurality of barbed needles in the second matrix;

a needle clamp hoop connected to the needle holder to retain the plurality of barbed needles in the needle holder; and a fixing jig connected to the needle clamp hoop configured to couple with a reciprocating bar of a needle punch machine.

4. The method of claim 3, further comprising loading the plurality of barbed needles into the plurality of sockets in the needle holder of the stitching jig such that each of the plurality of sockets holds a single barbed needle of the plurality of barbed needles.

5. The method of claim 3, further comprising:

loading the needle holder into the needle clamp hoop;

adjusting a position of the needle holder in the needle clamp hoop; and locking the position of the needle holder relative to the needle clamp hoop.

6. The method of claim 1, wherein moving the feeding frame comprises moving the feeding frame along a computer-controlled pattern.

7. A method for manufacturing an upper for an article of footwear, the method comprising:

cutting a first sheet of material and a second sheet of material into portions of the upper such that the first sheet of material at least partially forms a toe panel and the second sheet of material at least partially forms a heel panel;

after cutting the first sheet of material and the second sheet of material into the portions of the upper, laying out the first sheet of material that has been cut and positioning the second sheet of material that has been cut to at least partially overlap with the first sheet of material at an overlap;

positioning a felt material adjacent the overlap so that the second sheet of material is at least partially between the first sheet of material and the felt material; and felting the felt material to draw fibers of the felt material through the first and second sheets of material that have been cut to join the first and second sheets of material at a felting seam.

8. The method of claim 7, further comprising skiving the first sheet of material and the felt material at the overlap.

9. The method of claim 7, further comprising applying an anchor stitch along the overlap.

10. The method of claim 7, further comprising attaching a reinforcement material to portions of the first and second sheets of material to cover the felting seam.

11. The method of claim 10, wherein the reinforcement material is attached via adhesive.

12. The method of claim 10, further comprising joining the second sheet of material and the felt material away from the felting seam with an adhesive.

13. The method of claim 7, wherein felting the felt material to draw fibers of the felt material through the first and second sheets of material comprises:

advancing a matrix of barbed needles through the overlap and the felting material;

advancing the matrix of barbed needles into a matrix of holes in a hook cover plate;

retracting the matrix of barbed needles through the matrix of holes;

grasping fibers of the felting material with the matrix of barbed needles; and pulling the fibers of the felting material through the overlap.

14. The method of claim 7, wherein felting the felt material to draw fibers of the felt material through the first and second sheets of material comprises felting the felt material in different densities across the overlap to form a continuously increasing or decreasing felting density from the toe panel to the heel panel.

15. The method of claim 14, further comprising:

felting the first sheet of material on a first side of the overlap for a first period of time to form a first felting density; and felting the second sheet of material on a second side of the overlap opposite the first side for a second period of time to form a second felting density, the second period of time being less than the first period of time;

wherein the felting on the first side has a different density than the felting on the second side to produce a felting gradient across the upper.

16. A method of manufacturing a shoe upper, the method comprising:

loading a plurality of needles into a needle holder of a stitching jig, the needle holder having a plurality of individual needle sockets arranged in a first matrix of holes, wherein the first matrix of holes comprises a plurality of columns and rows of holes that are offset from each other so that holes in the plurality of columns and rows overlap with each other;

positioning a first sheet of material for the shoe upper adjacent a hook cover plate including a second matrix of holes matching the first matrix of holes;

positioning a second sheet of material for the shoe upper to at least partially overlap with the first sheet of material at an overlap adjacent the second matrix of holes;

positioning a felt material adjacent the overlap so that the second sheet of material is at least partially between the first sheet of material and the felt material;

reciprocating the stitching jig to repetitively advance the plurality of needles arranged in the first matrix through the overlap and into the second matrix of holes to draw fibers of the felt material through the first and second sheets of material to perform felting of the felt material in different densities across the overlap to form a continuously increasing or decreasing felting density from a toe panel to a heel panel;

felting the first sheet of material on a first side of the overlap for a first period of time to form a first felting density;

felting the second sheet of material on a second side of the overlap opposite the first side for a second period of time to form a second felting density, the second period of time being less than the first period of time;

wherein the felting on the first side has a different density than the felting on the second side to produce a felting gradient across the upper;

translating the first and second sheets of material to move the overlap along the second matrix of holes; and attaching the first sheet of material to the second sheet of material with entrained fibers of the first sheet of material and the second sheet of material.

17. The method of claim 16, wherein translating the first and second sheets of material to move the overlap along the first matrix of holes comprises:

mounting the first and second sheets of material in a feeding frame;

operating an actuation mechanism to move the feeding frame; and controlling operation of the actuation mechanism with a controller programmed to move the feeding frame over a pre-programmed pattern.

18. The method of claim 17, controlling operation of the actuation mechanism with a controller programmed to move the feeding frame over a pre-programmed pattern comprises moving the feeding frame to produce a felting gradient across the overlap.

19. The method of claim 16, further comprising forming the first sheet of material and the second sheet of material into the shoe upper such that the first sheet of material at least partially forms a toe panel and the second sheet of material at least partially forms a heel panel.

* * * * *